US008862480B2

(12) United States Patent
Fuchs et al.

(10) Patent No.: US 8,862,480 B2
(45) Date of Patent: Oct. 14, 2014

(54) AUDIO ENCODING/DECODING WITH ALIASING SWITCH FOR DOMAIN TRANSFORMING OF ADJACENT SUB-BLOCKS BEFORE AND SUBSEQUENT TO WINDOWING

(75) Inventors: Guillaume Fuchs, Erlangen (DE); Jeremie Lecomte, Fuerth (DE); Stefan Bayer, Nuremberg (DE); Ralf Geiger, Erlangen (DE); Markus Multrus, Nuremberg (DE); Gerald Schuller, Erfurt (DE); Jens Hirschfeld, Magstadt (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 933 days.

(21) Appl. No.: 13/004,351

(22) Filed: Jan. 11, 2011

(65) Prior Publication Data

US 2011/0173009 A1 Jul. 14, 2011

Related U.S. Application Data

(63) Continuation of application No. PCT/EP2009/004374, filed on Jun. 17, 2009.

(60) Provisional application No. 61/079,852, filed on Jul. 11, 2008.

(51) Int. Cl.

| | |
|---|---|
| ***G10L 19/02*** | (2013.01) |
| ***G10L 19/04*** | (2013.01) |
| ***G10L 19/20*** | (2013.01) |
| ***G10L 19/022*** | (2013.01) |

(52) U.S. Cl.

CPC ..... *G10L 19/20* (2013.01); *G10L 19/02* (2013.01); *G10L 19/04* (2013.01); *G10L 19/022* (2013.01)

USPC ..... 704/501; 704/203; 704/219

(58) Field of Classification Search

CPC ..... G10L 19/02; G10L 19/022; G10L 19/04; G10L 19/20

USPC ..... 704/203, 205, 500, 501, 219

See application file for complete search history.

(56) References Cited

U.S. PATENT DOCUMENTS

| | | | |
|---|---|---|---|
| 5,579,430 | A | 11/1996 | Grill et al. |
| 6,226,608 | B1 | 5/2001 | Fielder et al. |

(Continued)

FOREIGN PATENT DOCUMENTS

| | | |
|---|---|---|
| EP | 1278184 | 1/2003 |
| EP | 1396844 | 3/2004 |

(Continued)

OTHER PUBLICATIONS

J. Princen, A. Bradley, "Analysis/Synthesis Filter Bank Design Based on Time Domain Aliasing Cancellation", IEEE Trans. ASSP, ASSP-34(5):1153-1161, 1986.

(Continued)

*Primary Examiner* — Martin Lerner

(74) *Attorney, Agent, or Firm* — Michael A. Glenn; Perkins Coie LLP

(57) ABSTRACT

An apparatus for encoding an audio signal includes the windower for windowing a first block of the audio signal using an analysis window having an aliasing portion and a further portion. The apparatus furthermore includes a processor for processing the first sub-block of the audio signal associated with the aliasing portion by transforming the sub-block from a domain into a different domain subsequent to windowing the first sub-block to obtain the processed first sub-block, and for processing a second sub-block of the audio signal associated with the further portion by transforming the second sub-block from the domain into the different domain before windowing the second sub-block to obtain a processed second sub-block. Thus, a critically sampled switch between two coding modes can be obtained.

17 Claims, 19 Drawing Sheets

(56) References Cited

U.S. PATENT DOCUMENTS

| | | | | |
|---|---|---|---|---|
| 6,449,596 | B1 | 9/2002 | Ejima | |
| 7,145,484 | B2 * | 12/2006 | Moriya et al. | 341/76 |
| 7,747,430 | B2 * | 6/2010 | Makinen | 704/219 |
| 7,876,966 | B2 * | 1/2011 | Ojanpera | 382/232 |
| 8,275,626 | B2 * | 9/2012 | Neuendorf et al. | 704/501 |
| 8,311,809 | B2 | 11/2012 | Schuijers et al. | |
| 8,321,210 | B2 * | 11/2012 | Grill et al. | 704/205 |
| 8,326,606 | B2 * | 12/2012 | Oshikiri | 704/200.1 |
| 8,682,645 | B2 * | 3/2014 | Taleb et al. | 704/219 |
| 8,725,503 | B2 * | 5/2014 | Bessette | 704/229 |
| 2003/0009325 | A1 * | 1/2003 | Kirchherr et al. | 704/211 |
| 2004/0088160 | A1 * | 5/2004 | Manu | 704/203 |
| 2004/0181403 | A1 | 9/2004 | Hsu | |
| 2006/0047523 | A1 | 3/2006 | Ojanpera | |
| 2006/0173675 | A1 * | 8/2006 | Ojanpera | 704/203 |
| 2006/0247928 | A1 | 11/2006 | Cowdery | |
| 2007/0033021 | A1 | 2/2007 | Lin et al. | |
| 2007/0282600 | A1 * | 12/2007 | Ojanpera | 704/207 |
| 2008/0027719 | A1 | 1/2008 | Kirshnan et al. | |
| 2008/0065373 | A1 * | 3/2008 | Oshikiri | 704/203 |
| 2008/0140428 | A1 * | 6/2008 | Choo et al. | 704/500 |
| 2008/0294429 | A1 * | 11/2008 | Su et al. | 704/222 |
| 2010/0017213 | A1 * | 1/2010 | Edler et al. | 704/500 |
| 2011/0173008 | A1 * | 7/2011 | Lecomte et al. | 704/500 |
| 2013/0090929 | A1 * | 4/2013 | Ishikawa et al. | 704/262 |
| 2013/0124215 | A1 * | 5/2013 | Lecomte et al. | 704/500 |

FOREIGN PATENT DOCUMENTS

| | | |
|---|---|---|
| RU | 2141166 | 11/1999 |
| RU | 2005135650 | 3/2006 |
| TW | 594674 | 6/2004 |
| TW | 200623027 | 7/2006 |
| TW | I271703 | 1/2007 |
| TW | 200705385 | 2/2007 |
| TW | 200816718 | 4/2008 |
| WO | WO 2004/082288 | 9/2004 |
| WO | WO 2008/071353 A2 | 6/2008 |

OTHER PUBLICATIONS

Generic Coding of Moving Pictures and Associated Audio: Advanced Audio Coding. International Standard 13818-7, ISO/IEC JTC1/SC29/WG11 Moving Pictures Expert Group, 1997.

Sean A. Ramprashad, "The Multimode Transform predictive Coding Paradigm", IEEE; Transaction on Speech and Audio Processing, vol. 11, No. 2, Mar. 2003.

Sang-Wook Shin et al: "Designing a unified speech/audio codec by adopting a single channel harmonic source separation module", Acoustics, Speech and Signal Processing, 2008. ICASSP 2008. IEEE International Conference on, IEEE, Piscataway NJ, USA; Mar. 31, 2008.

Neuendorf et al: "Unified speech and audio coding scheme for high quality at low bitrates" Acoustics, Speech and Signal Processing, 2009. ICASSP 2009. IEEE International Conference on, IEEE, Piscataway, NJ, USA, Apr. 19, 2009.

PCT/2009/004374 International Search Report and Written Opinion; 21 pages; Jun. 10, 2009, and Aug. 11, 2010.

* cited by examiner (encoder side)

(decoder side)

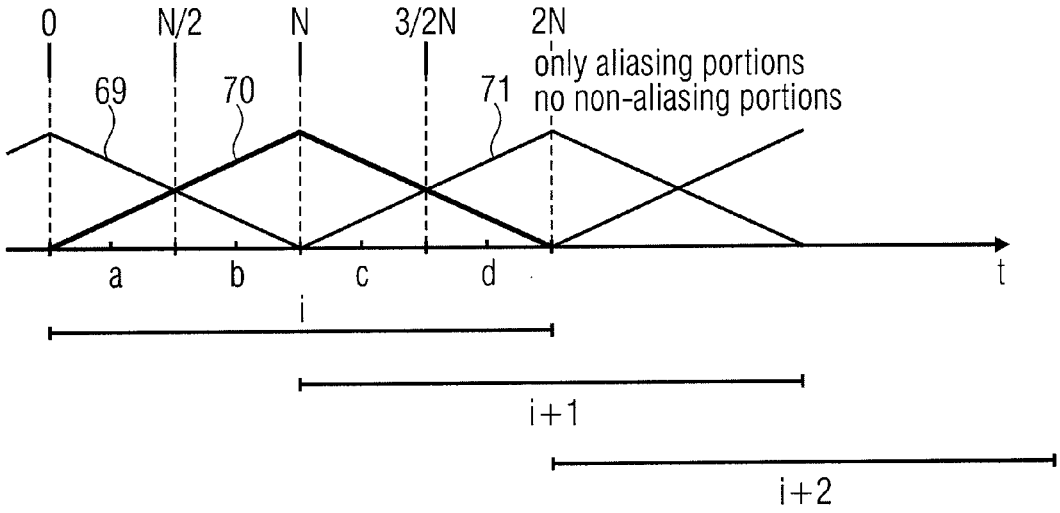

FOLDING: $(-c_R-d,\ a-b_R)$ R: reverse operator (2N input values ↓ N output values)

UNFOLDING: $(a-b_R,\ b-a_R,\ c+d_R,\ d+c_R)\cdot\frac{1}{2}$ (N input values ↓ 2N output values) $\text{MDCT}\underbrace{(a,b,s,d)}_{\text{2N input values}} \equiv \text{DCT-IV}\underbrace{(-c_R-d,\ a-b_R)}_{\text{N input values}}$ $$\underbrace{\text{IMDCT}(\text{MDCT}(a,b,c,d))}_{\text{2N output values}} = (a-b_R,\ b-a_R,\ c+d_R,\ d+c_R)\cdot\frac{1}{2}$$

FIG 4A specific sequence of windowing for transitions between AAC and AMR-WB+

TCX-MDCT for the $R_k$=128 last samples before a AAC segment

TCX-MDCT for the $L_k$=128 first samples after a AAC segment

AUDIO ENCODING/DECODING WITH ALIASING SWITCH FOR DOMAIN TRANSFORMING OF ADJACENT SUB-BLOCKS BEFORE AND SUBSEQUENT TO WINDOWING

CROSS-REFERENCE TO RELATED APPLICATIONS

This application is a continuation of copending International Application No. PCT/EP2009/004374, filed Jun. 17, 2009, which is incorporated herein by reference in its entirety, and additionally claims priority from U.S. Application No. 61/079,852, filed Jul. 11, 2008, which is incorporated herein by reference in its entirety.

BACKGROUND OF THE INVENTION

The present invention is related to audio coding and, particularly, to low bit rate audio coding schemes.

In the art, frequency domain coding schemes such as MP3 or AAC are known. These frequency-domain encoders are based on a time-domain/frequency-domain conversion, a subsequent quantization stage, in which the quantization error is controlled using information from a psychoacoustic module, and an encoding stage, in which the quantized spectral coefficients and corresponding side information are entropy-encoded using code tables.

On the other hand there are encoders that are very well suited to speech processing such as the AMR-WB+ as described in 3GPP TS 26.290. Such speech coding schemes perform a Linear Predictive filtering of a time-domain signal. Such a LP filtering is derived from a Linear Prediction analysis of the input time-domain signal. The resulting LP filter coefficients are then quantized/coded and transmitted as side information. The process is known as Linear Prediction Coding (LPC). At the output of the filter, the prediction residual signal or prediction error signal which is also known as the excitation signal is encoded using the analysis-by-synthesis stages of the ACELP encoder or, alternatively, is encoded using a transform encoder, which uses a Fourier transform with an overlap. The decision between the ACELP coding and the Transform Coded eXcitation coding which is also called TCX coding is done using a closed loop or an open loop algorithm.

Frequency-domain audio coding schemes such as the high efficiency-AAC encoding scheme, which combines an AAC coding scheme and a spectral band replication technique can also be combined with a joint stereo or a multi-channel coding tool which is known under the term "MPEG surround".

On the other hand, speech encoders such as the AMR-WB+ also have a high frequency enhancement stage and a stereo functionality.

Frequency-domain coding schemes are advantageous in that they show a high quality at low bitrates for music signals. Problematic, however, is the quality of speech signals at low bitrates.

Speech coding schemes show a high quality for speech signals even at low bitrates, but show a poor quality for music signals at low bitrates.

Frequency-domain coding schemes often make use of the so-called MDCT (MDCT=modified discrete Cosine transform). The MDCT has been initially described in J. Princen, A. Bradley, "Analysis/Synthesis Filter Bank Design Based on Time Domain Aliasing Cancellation", IEEE Trans. ASSP, ASSP-34(5):1153-1161, 1986. The MDCT or MDCT filter bank is widely used in modern and efficient audio coders. This kind of signal processing provides the following advantages:

Smooth cross-fade between processing blocks: Even if the signal in each processing block is altered differently (e.g. due to quantization of spectral coefficients), no blocking artifacts due to abrupt transitions from block to block occur because of the windowed overlap/add operation.

Critical sampling: The number of spectral values at the output of the filterbank is equal to the number of time domain input values at its input and additional overhead values have to be transmitted.

The MDCT filterbank provides a high frequency selectivity and coding gain.

Those great properties are achieved by utilizing the technique of time domain aliasing cancellation. The time domain aliasing cancellation is done at the synthesis by overlap-adding two adjacent windowed signals. If no quantization is applied between the analysis and the synthesis stages of the MDCT, a perfect reconstruction of the original signal is obtained. However, the MDCT is used for coding schemes, which are specifically adapted for music signals. Such frequency-domain coding schemes have, as stated before, reduced quality at low bit rates or speech signals, while specifically adapted speech coders have a higher quality at comparable bit rates or even have significantly lower bit rates for the same quality compared to frequency-domain coding schemes.

Speech coding techniques such as the so-called AMR-WB+ codec as defined in "Extended Adaptive Multi-Rate-Wideband (AMR-WB+) codec", 3GPP TS 26.290 V6.3.0, 2005-06, Technical Specification, do not apply the MDCT and, therefore, can not take any advantage from the excellent properties of the MDCT which, specifically, rely in a critically sampled processing on the one hand and a crossover from one block to the other on the other hand. Therefore, the crossover from one block to the other obtained by the MDCT without any penalty with respect to bit rate and, therefore, the critical sampling property of MDCT has not yet been obtained in speech coders.

When one would combine speech coders and audio coders within a single hybrid coding scheme, there is still the problem of how to obtain a switch from one coding mode to the other coding mode at a low bit rate and a high quality.

SUMMARY

According to an embodiment, an apparatus for encoding an audio signal may have: a windower for windowing a first block of the audio signal using an analysis window, the analysis window having an aliasing portion, and a further portion; a processor for processing a first sub-block of the audio signal associated with the aliasing portion by transforming the first sub-block into a domain different from the domain, in which the audio signal is, subsequent to windowing the first sub-block to obtain a processed first sub-block, and for processing a second sub-block of the audio signal associated with the further portion by transforming the second sub-block into the different domain before windowing the second sub-block to obtain a processed second sub-block; and a transformer for converting the processed first sub-block and the processed second sub-block from the different domain into a further domain using the same block transform rule to obtain a converted first block, wherein the apparatus is configured for further processing the converted first block using a data compression algorithm.

According to another embodiment, an apparatus for decoding an encoded audio signal having an encoded first block of audio data, the encoded block having an aliasing portion and a further portion, may have: a processor for processing the aliasing portion by transforming the aliasing portion into a target domain before performing a synthesis windowing to obtain a windowed aliasing portion, and for performing a synthesis windowing of the further portion before performing a transform into the target domain; and a time domain aliasing canceller for combining the windowed aliasing portion and the windowed aliasing portion of an encoded second block of audio data subsequent to a transform of the aliasing portion of the encoded first block of audio data into the target domain to obtain a decoded audio signal corresponding to the aliasing portion of the first block.

Another embodiment may have an encoded audio signal having an encoded first block of an audio signal and an overlapping encoded second block of the audio signal, the encoded first block of the audio signal having an aliasing portion and a further portion, the aliasing portion having been transformed from a first domain to a second domain subsequent to windowing the aliasing portion, and the further portion having been transformed from the first domain into the second domain before windowing the second sub-block, wherein the second sub-block has been transformed into a fourth domain using the same block transform rule, and wherein the encoded second block has been generated by windowing an overlapping block of audio samples and by transforming a windowed block into a third domain, wherein the encoded second block has an aliasing portion corresponding to the aliasing portion of the encoded first block of audio samples.

According to another embodiment, a method of encoding an audio signal may have the steps of: windowing a first block of the audio signal using an analysis window, the analysis window having an aliasing portion, and a further portion; processing a first sub-block of the audio signal associated with the aliasing portion by transforming the first sub-block into a domain different from the domain, in which the audio signal is, subsequent to windowing the first sub-block to obtain a processed first sub-block; processing a second sub-block of the audio signal associated with the further portion by transforming the second sub-block into the different domain before windowing the second sub-block to obtain a processed second sub-block; converting the processed first sub-block and the processed second sub-block from the different domain into a further domain using the same block transform rule to obtain a converted first block; and further processing the converted first block using a data compression algorithm.

According to another embodiment, a method of decoding an encoded audio signal having an encoded first block of audio data, the encoded block having an aliasing portion and a further portion, may have the steps of: processing the aliasing portion by transforming the aliasing portion into a target domain before performing a synthesis windowing to obtain a windowed aliasing portion; a synthesis windowing of the further portion before performing a transform into the target domain; and combining the windowed aliasing portion and the windowed aliasing portion of an encoded second block of audio data to obtain a time-domain aliasing cancellation, subsequent to a transform of the aliasing portion of the encoded first block of audio data into the target domain to obtain a decoded audio signal corresponding to the aliasing portion of the first block.

Another embodiment may have a computer program having a program code for performing, when running on a computer, the inventive method for encoding or the inventive method of decoding.

An aspect of the present invention is that a hybrid coding scheme is applied, in which a first coding mode specifically adapted for certain signals and operating in one domain is applied, and in which a further coding mode specifically adapted for other signals and operation in a different domain are used together. In this coding/decoding concept, a critically sampled switch from one coding mode to the other coding mode is made possible in that, on the encoder side, the same block of audio samples which has been generated by one windowing operation is processed differently. Specifically, an aliasing portion of the block of the audio signal is processed by transforming the sub-block associated with the aliasing portion of the window from one domain into the other domain subsequent to windowing this sub-block, where a different sub-block obtained by the same windowing operation is transformed from one domain into the other domain before windowing this sub-block using an analysis window.

The processed first sub-block and the processed second sub-block are, subsequently, transformed into a further domain using the same block transform rule to obtain a converted first block of the audio signal which can then be further processed using any of the well-known data compression algorithms such as quantizing, entropy encoding and so on.

On the decoder-side, this block is again processed differently based on whether the aliasing portion of the block is processed or the other further portion of the block is processed. The aliasing portion is transformed into a target domain before performing a synthesis windowing while the further portion is subject to a synthesis windowing before performing the transforming to the target domain. Additionally, in order to obtain the critically sampling property, a time domain aliasing cancellation is performed, in which the windowed aliasing portion and a windowed aliasing portion of an encoded other block of the audio data are combined subsequent to a transform of the aliasing portion of the encoded audio signal block into the target domain so that a decoded audio signal corresponding to the aliasing portion of the first block is obtained. In view of that, there do exist two sub-blocks/portions in a window. One portion/sub-block (aliasing sub-block) has aliasing components, which overlap a second block coded in a different domain, and a second sub-block/portion (further sub-block), which may or may not have aliasing components which overlaps the second block or a block different from the second block.

The aliasing introduced into certain portions which correspond to each other, but which are encoded in different domains is advantageously used for obtaining a critically sampled switch from one coding mode to the other coding mode by differently processing the aliasing portion and the further portion within one and the same windowed block of audio sample.

This is in contrast to conventional processing based on analysis windows and synthesis windows, since, up to now, a complete data block obtained by applying an analysis window has been subjected to the same processing. In accordance with the present invention, however, the aliasing portion of the windowed block is processed differently compared to the further portion of this block.

The further portion can comprise a non-aliasing portion occurring, when specific start/stop windows are used. Alternatively, the further portion can comprise an aliasing portion overlapping with a portion of the result of an adjacent windowing process. Then, the further (aliasing) portion overlaps with an aliasing portion of a neighboring frame processed in the same domain compared to the further (aliasing) portion of the current frame, and the aliasing portion overlaps with an aliasing portion of a neighboring frame processed in a different domain compared to the aliasing portion of the current frame.

Depending on the implementation, the further portion and the aliasing portion together form the complete result of an application of a window function to a block of audio samples. The further portion can be completely aliasing free or can be completely aliasing or can include an aliasing sub-portion and an aliasing free sub-portion.

Furthermore, the order of theses sub-portions and the order of the aliasing portion and the further portion can be arbitrarily selected.

In an embodiment of the switched audio coding scheme, adjacent segments of the input signal could be processed in two different domains. For example, AAC computes a MDCT in the signal domain, and the MTPC (Sean A. Ramprashad, "The Multimode Transform Predictive Coding Paradigm", IEEE Transaction on Speech and Audio Processing, Vol. 11, No. 2, March 2003) computes a MDCT in the LPC residual domain. It could be problematic especially when the overlapped regions have time-domain aliasing components due to the use of a MDCT. Indeed, the time-domain aliasing can not be cancelled in the transitions where going from one coder to another, because they were produced in two different domains. One solution is to make the transitions with aliasing-free cross-fade windowed signals. The switched coder is then no more critically sampled and produces an overhead of information. Embodiments permit to maintain the critically sampling advantage by canceling time-domain aliasing components computed by operating in two different domains.

In an embodiment of the present invention, two switches are provided in a sequential order, where a first switch decides between coding in the spectral domain using a frequency-domain encoder and coding in the LPC-domain, i.e., processing the signal at the output of an LPC analysis stage. The second switch is provided for switching in the LPC-domain in order to encode the LPC-domain signal either in the LPC-domain such as using an ACELP coder or coding the LPC-domain signal in an LPC-spectral domain, which necessitates a converter for converting the LPC-domain signal into an LPC-spectral domain, which is different from a spectral domain, since the LPC-spectral domain shows the spectrum of an LPC filtered signal rather than the spectrum of the time-domain signal.

The first switch decides between two processing branches, where one branch is mainly motivated by a sink model and/or a psycho acoustic model, i.e. by auditory masking, and the other one is mainly motivated by a source model and by segmental SNR calculations. Exemplarily, one branch has a frequency domain encoder and the other branch has an LPC-based encoder such as a speech coder. The source model is usually the speech processing and therefore LPC is commonly used.

The second switch again decides between two processing branches, but in a domain different from the "outer" first branch domain. Again one "inner" branch is mainly motivated by a source model or by SNR calculations, and the other "inner" branch can be motivated by a sink model and/or a psycho acoustic model, i.e. by masking or at least includes frequency/spectral domain coding aspects. Exemplarily, one "inner" branch has a frequency domain encoder/spectral converter and the other branch has an encoder coding on the other domain such as the LPC domain, wherein this encoder is for example an CELP or ACELP quantizer/scaler processing an input signal without a spectral conversion.

A further embodiment is an audio encoder comprising a first information sink oriented encoding branch such as a spectral domain encoding branch, a second information source or SNR oriented encoding branch such as an LPC-domain encoding branch, and a switch for switching between the first encoding branch and the second encoding branch, wherein the second encoding branch comprises a converter into a specific domain different from the time domain such as an LPC analysis stage generating an excitation signal, and wherein the second encoding branch furthermore comprises a specific domain such as LPC domain processing branch and a specific spectral domain such as LPC spectral domain processing branch, and an additional switch for switching between the specific domain coding branch and the specific spectral domain coding branch.

A further embodiment of the invention is an audio decoder comprising a first domain such as a spectral domain decoding branch, a second domain such as an LPC domain decoding branch for decoding a signal such as an excitation signal in the second domain, and a third domain such as an LPC-spectral decoder branch for decoding a signal such as an excitation signal in a third domain such as an LPC spectral domain, wherein the third domain is obtained by performing a frequency conversion from the second domain wherein a first switch for the second domain signal and the third domain signal is provided, and wherein a second switch for switching between the first domain decoder and the decoder for the second domain or the third domain is provided.

BRIEF DESCRIPTION OF THE DRAWINGS

Embodiments of the present invention will be detailed subsequently referring to the appended drawings, in which:

FIG. 4A illustrates details of aliasing-transforms such as the MDCT applicable in both encoding modes;

DETAILED DESCRIPTION OF THE INVENTION

Figure 11A:
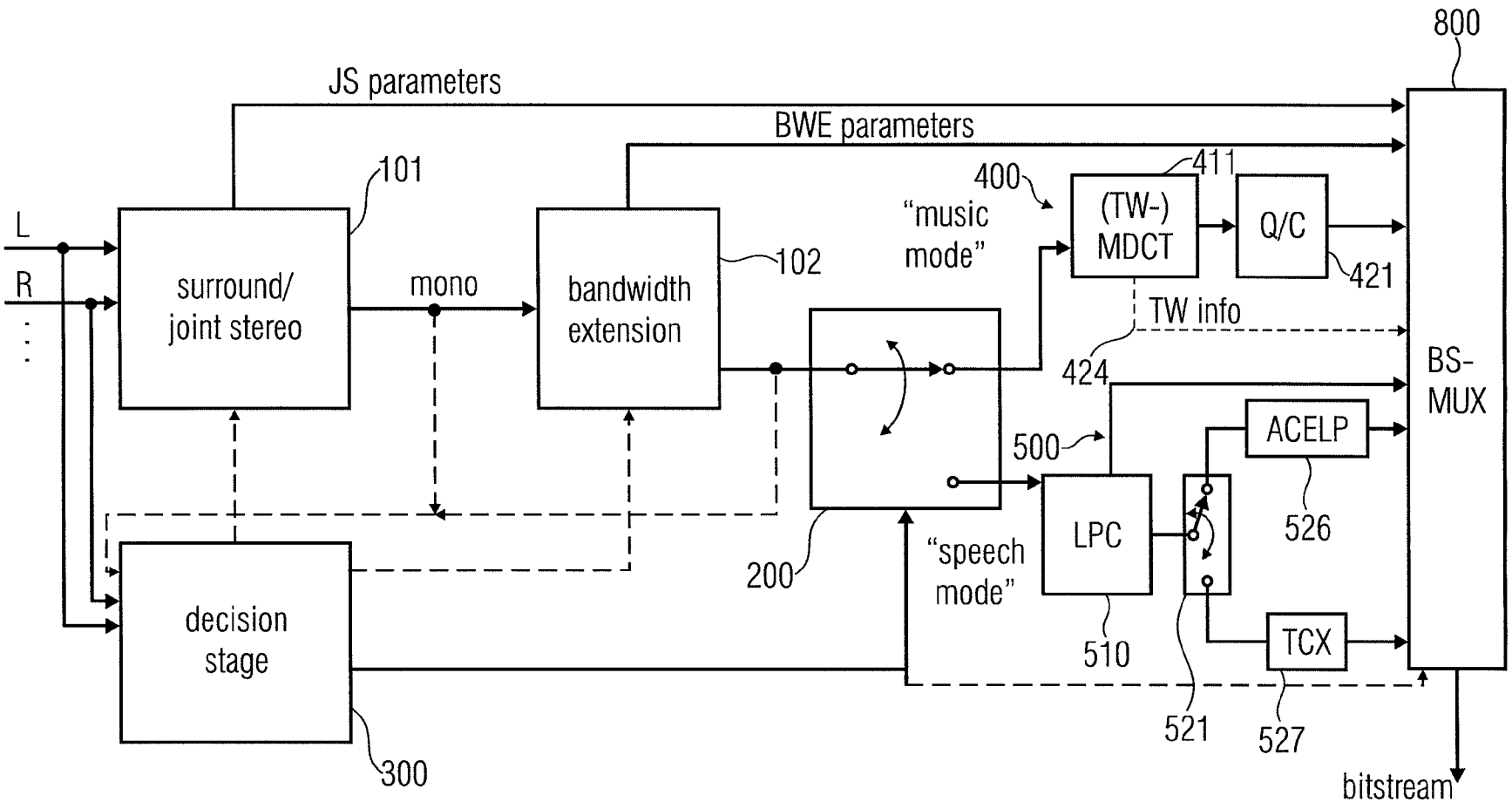
FIG. 11A illustrates an embodiment of an encoder in which the present invention is applied.

FIG. 11A illustrates an embodiment of the invention having two cascaded switches. A mono signal, a stereo signal or a multi-channel signal is input into a switch 200. The switch 200 is controlled by a decision stage 300. The decision stage receives, as an input, a signal input into block 200. Alternatively, the decision stage 300 may also receive a side information which is included in the mono signal, the stereo signal or the multi-channel signal or is at least associated to such a signal, where information is existing, which was, for example, generated when originally producing the mono signal, the stereo signal or the multi-channel signal.

The decision stage 300 actuates the switch 200 in order to feed a signal either in a frequency encoding portion 400 illustrated at an upper branch of FIG. 11A or an LPC-domain encoding portion 500 illustrated at a lower branch in FIG. 11A. A key element of the frequency domain encoding branch is a spectral conversion block 411 which is operative to convert a common preprocessing stage output signal (as discussed later on) into a spectral domain. The spectral conversion block may include an MDCT algorithm, a QMF, an FFT algorithm, a Wavelet analysis or a filterbank such as a critically sampled filterbank having a certain number of filterbank channels, where the sub-band signals in this filterbank may be real valued signals or complex valued signals. The output of the spectral conversion block 411 is encoded using a spectral audio encoder 421, which may include processing blocks as known from the AAC coding scheme.

Generally, the processing in branch 400 is a processing in a perception based model or information sink model. Thus, this branch models the human auditory system receiving sound. Contrary thereto, the processing in branch 500 is to generate a signal in the excitation, residual or LPC domain. Generally, the processing in branch 500 is a processing in a speech model or an information generation model. For speech signals, this model is a model of the human speech/sound generation system generating sound. If, however, a sound from a different source necessitating a different sound generation model is to be encoded, then the processing in branch 500 may be different.

In the lower encoding branch 500, a key element is an LPC device 510, which outputs an LPC information which is used for controlling the characteristics of an LPC filter. This LPC information is transmitted to a decoder. The LPC stage 510 output signal is an LPC-domain signal which consists of an excitation signal and/or a weighted signal.

The LPC device generally outputs an LPC domain signal, which can be any signal in the LPC domain such as an excitation signal or a weighted (TCX) signal or any other signal, which has been generated by applying LPC filter coefficients to an audio signal. Furthermore, an LPC device can also determine these coefficients and can also quantize/encode these coefficients.

The decision in the decision stage can be signal-adaptive so that the decision stage performs a music/speech discrimination and controls the switch 200 in such a way that music signals are input into the upper branch 400, and speech signals are input into the lower branch 500. In one embodiment, the decision stage is feeding its decision information into an output bit stream so that a decoder can use this decision information in order to perform the correct decoding operations.

Figure 11B:
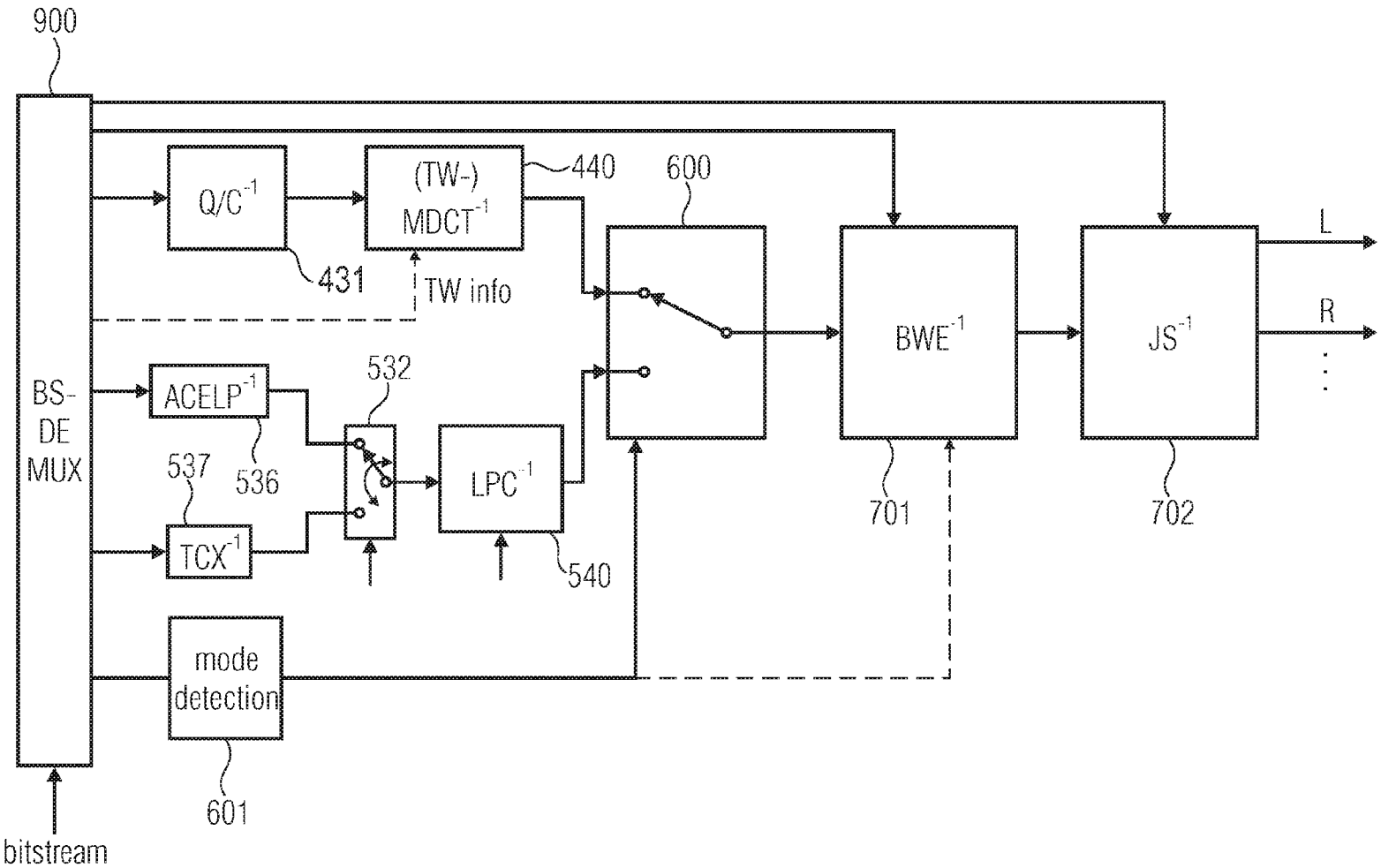
FIG. 11B illustrates a decoder, in which the present invention is applied.

Such a decoder is illustrated in FIG. 11B. The signal output by the spectral audio encoder 421 is, after transmission, input into a spectral audio decoder 431. The output of the spectral audio decoder 431 is input into a time-domain converter 440. Analogously, the output of the LPC domain encoding branch 500 of FIG. 11A is received on the decoder side and processed by elements 536 and 537 for obtaining an LPC excitation signal. The LPC excitation signal is input into an LPC synthesis stage 540, which receives, as a further input, the LPC information generated by the corresponding LPC analysis stage 510. The output of the time-domain converter 440 and/or the output of the LPC synthesis stage 540 are input into a switch 600. The switch 600 is controlled via a switch control signal which was, for example, generated by the decision stage 300, or which was externally provided such as by a creator of the original mono signal, stereo signal or multi-channel signal. The output of the switch 600 is a complete mono signal, stereo signal or multi-channel signal.

The input signal into the switch 200 and the decision stage 300 can be a mono signal, a stereo signal, a multi-channel signal or generally an audio signal. Depending on the decision which can be derived from the switch 200 input signal or from any external source such as a producer of the original audio signal underlying the signal input into stage 200, the switch switches between the frequency encoding branch 400 and the LPC encoding branch 500. The frequency encoding branch 400 comprises a spectral conversion stage 411 and a subsequently connected quantizing/coding stage 421. The quantizing/coding stage can include any of the functionalities as known from modern frequency-domain encoders such as the AAC encoder. Furthermore, the quantization operation in the quantizing/coding stage 421 can be controlled via a psychoacoustic module which generates psychoacoustic information such as a psychoacoustic masking threshold over the frequency, where this information is input into the stage 421.

In the LPC encoding branch, the switch output signal is processed via an LPC analysis stage 510 generating LPC side info and an LPC-domain signal. The excitation encoder comprises an additional switch 521 for switching the further processing of the LPC-domain signal between a quantization/coding operation 526 in the LPC-domain or a quantization/coding stage 527, which is processing values in the LPC-spectral domain. To this end, a spectral converter 527 is provided. The switch 521 is controlled in an open loop fashion or a closed loop fashion depending on specific settings as, for example, described in the AMR-WB+ technical specification.

For the closed loop control mode, the encoder additionally includes an inverse quantizer/coder for the LPC domain signal, an inverse quantizer/coder for the LPC spectral domain signal and an inverse spectral converter for the output of the inverse quantizer/coder. Both encoded and again decoded signals in the processing branches of the second encoding branch are input into a switch control device. In the switch control device, these two output signals are compared to each other and/or to a target function or a target function is calculated which may be based on a comparison of the distortion in both signals so that the signal having the lower distortion is used for deciding, which position the switch 521 should take. Alternatively, in case both branches provide non-constant bit rates, the branch providing the lower bit rate might be selected even when the signal to noise ratio of this branch is lower than the signal to noise ratio of the other branch. Alternatively, the target function could use, as an input, the signal to noise ratio of each signal and a bit rate of each signal and/or additional criteria in order to find the best decision for a specific goal. If, for example, the goal is such that the bit rate should be as low as possible, then the target function would heavily rely on the bit rate of the two signals output by the inverse quantizer/coder and the inverse spectral converter. However, when the main goal is to have the best quality for a certain bit rate, then the switch control might, for example, discard each signal which is above the allowed bit rate and when both signals are below the allowed bit rate, the switch control would select the signal having the better signal to noise ratio, i.e., having the smaller quantization/coding distortions.

Figure 1A:
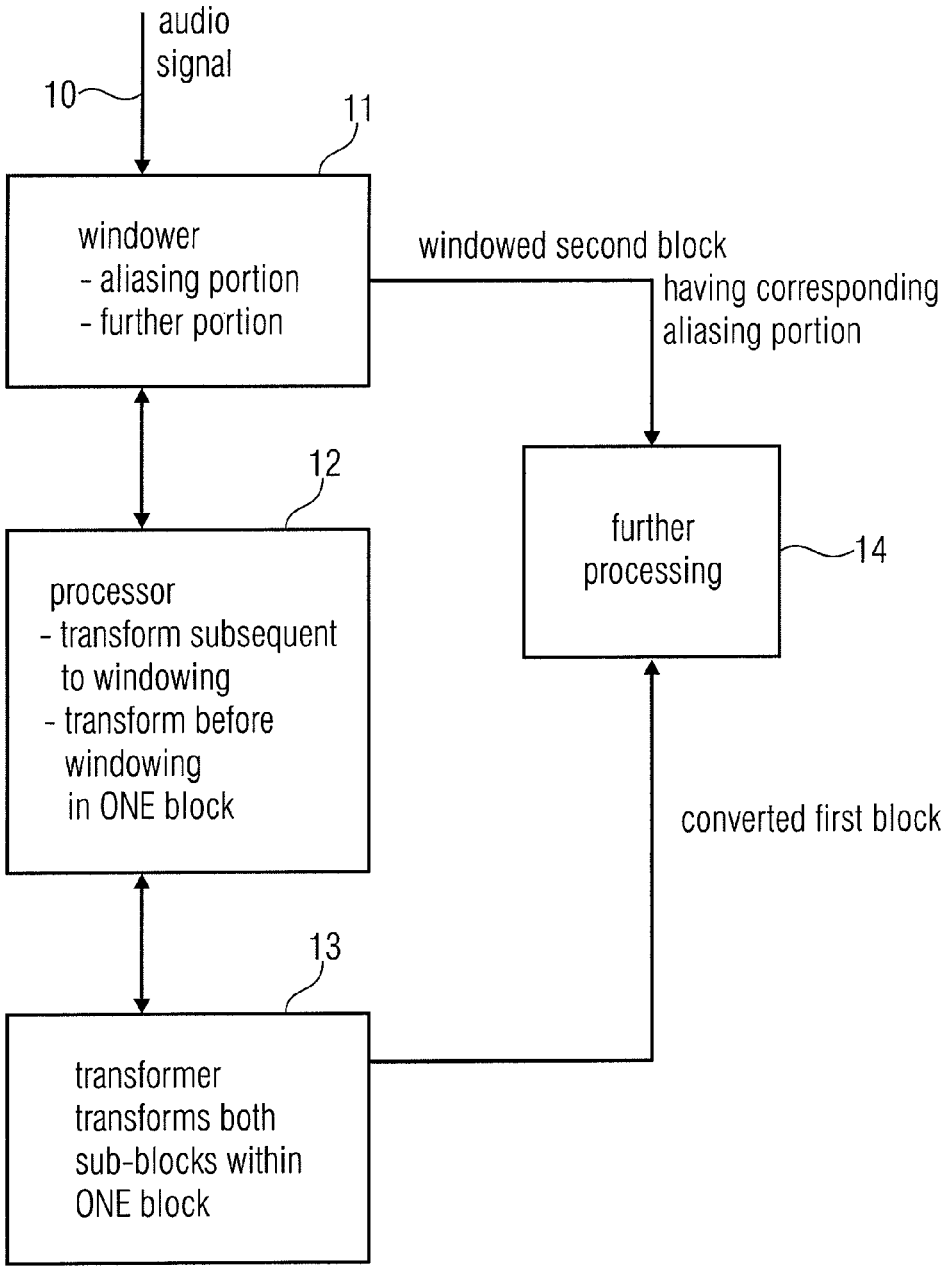
FIG. 1A is a schematic representation of an apparatus or method for encoding an audio signal.
Figure 1B:
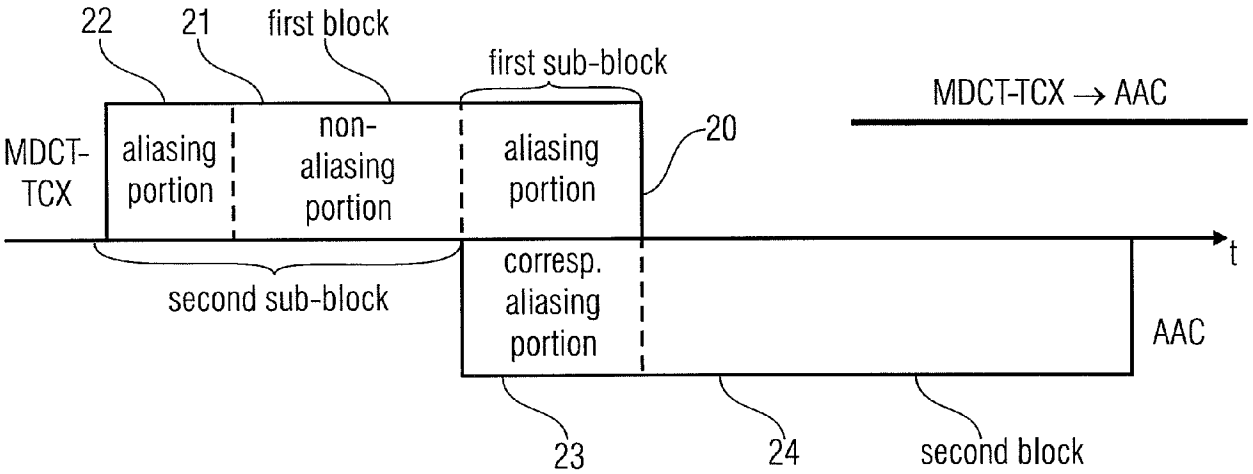
FIG. 1B is a schematic representation of the transition from MDCT-TCX to AAC.

The decoding scheme in accordance with the present invention is, as stated before, illustrated in FIG. 1B. For each of the three possible output signal kinds, a specific decoding/re-quantizing stage 431, 536 or 537 exists. While stage 431 outputs a frequency-spectrum, which may also be called "time-spectrum" (frequency spectrum of the time domain signal), and which is converted into the time-domain using the frequency/time converter 440, stage 536 outputs an LPC-domain signal, and item 537 receives an frequency-spectrum of the LPC-domain signal, which may also be called an "LPC-spectrum". In order to make sure that the input signals into switch 532 are both in the LPC-domain, a frequency/time converter 537 is provided in the LPC domain. The output data of the switch 532 is transformed back into the time-domain using an LPC synthesis stage 540, which is controlled via encoder-side generated and transmitted LPC information. Then, subsequent to block 540, both branches have time-domain information which is switched in accordance with a switch control signal in order to finally obtain an audio signal such as a mono signal, a stereo signal or a multi-channel signal, which depends on the signal input into the encoding scheme of FIG. 11A.

FIG. 11A therefore, illustrates an encoding scheme in accordance with the invention. A common preprocessing scheme connected to the switch 200 input may comprise a surround/joint stereo block 101 which generates, as an output, joint stereo parameters and a mono output signal, which is generated by downmixing the input signal which is a signal having two or more channels. Generally, the signal at the output of block 101 can also be a signal having more channels, but due to the downmixing functionality of block 101, the number of channels at the output of block 101 will be smaller than the number of channels input into block 101.

The common preprocessing scheme may comprise alternatively to the block 101 or in addition to the block 101*a* bandwidth extension stage 102. In the FIG. 11A embodiment, the output of block 101 is input into the bandwidth extension block 102 which, in the encoder of FIG. 11A, outputs a band-limited signal such as the low band signal or the low pass signal at its output. This signal is downsampled (e.g. by a factor of two) as well. Furthermore, for the high band of the signal input into block 102, bandwidth extension parameters such as spectral envelope parameters, inverse filtering parameters, noise floor parameters etc. as known from HE-AAC profile of MPEG-4 are generated and forwarded to a bitstream multiplexer 800.

The decision stage 300 receives the signal input into block 101 or input into block 102 in order to decide between, for example, a music mode or a speech mode. In the music mode, the upper encoding branch 400 is selected, while, in the speech mode, the lower encoding branch 500 is selected. The decision stage additionally controls the joint stereo block 101 and/or the bandwidth extension block 102 to adapt the functionality of these blocks to the specific signal. Thus, when the decision stage determines that a certain time portion of the input signal is of the first mode such as the music mode, then specific features of block 101 and/or block 102 can be controlled by the decision stage 300. Alternatively, when the decision stage 300 determines that the signal is in a speech mode or, generally, in a second LPC-domain mode, then specific features of blocks 101 and 102 can be controlled in accordance with the decision stage output.

The spectral conversion of the coding branch 400 is done using an MDCT operation which is the time-warped MDCT operation, where the strength or, generally, the warping strength can be controlled between zero and a high warping strength. In a zero warping strength, the MDCT operation in block 411 is a straightforward MDCT operation known in the art. The time warping strength together with time warping side information can be transmitted/input into the bitstream multiplexer 800 as side information.

In the LPC encoding branch, the LPC-domain encoder may include an ACELP core 526 calculating a pitch gain, a pitch lag and/or codebook information such as a codebook index and gain. The TCX mode as known from 3GPP TS 26.290 incurs a processing of a perceptually weighted signal in the transform domain. A Fourier transformed weighted signal is quantized using a split multi-rate lattice quantization (algebraic VQ) with noise factor quantization. A transform is calculated in 1024, 512, or 256 sample windows. The excitation signal is recovered by inverse filtering the quantized weighted signal through an inverse weighting filter.

In the first coding branch 400, a spectral converter comprises a specifically adapted MDCT operation having certain window functions followed by a quantization/entropy encoding stage which may consist of a single vector quantization stage, but is a combined scalar quantizer/entropy coder similar to the quantizer/coder in the frequency domain coding branch, i.e., in item 421 of FIG. 11A.

In the second coding branch, there is the LPC block 510 followed by a switch 521, again followed by an ACELP block 526 or an TCX block 527. ACELP is described in 3GPP TS 26.190 and TCX is described in 3GPP TS 26.290. Generally, the ACELP block 526 receives an LPC excitation signal. The TCX block 527 receives a weighted signal.

In TCX, the transform is applied to the weighted signal computed by filtering the input signal through an LPC-based weighting filter. The weighting filter used in embodiments of the invention is given by $(1-A(z/\gamma))/(1-\mu z^{-1})$. Thus, the weighted signal is an LPC domain signal and its transform is an LPC-spectral domain. The signal processed by ACELP block 526 is the excitation signal and is different from the signal processed by the block 527, but both signals are in the LPC domain. The excitation signal is obtained by filtering the input signal through the analysis filter $(1-A(z/\gamma))$.

At the decoder side illustrated in FIG. 11B, after the inverse spectral transform in block 537, the inverse of the weighting filter is applied, that is $(1-\mu z^{-1})/(1-A(z/\gamma))$. Optionally, the signal can be filtered additionally through $(1-A(z))$ to go to the LPC excitation domain. Thus, a signal from the $TCX^{-1}$ block 537 can be converted from the weighted domain to the excitation domain by a filtering through $$\frac{(1-\mu z^{-1})}{(1-A(z/\gamma))}(1-A(z))$$

and then be used in the block 536. This typical filtering is done in AMR-WB+ at the end of the inverse TCX (537) for feeding the adaptive codebook of ACELP in case this last coding is selected for the next frame.

Although item 510 in FIG. 11A illustrates a single block, block 510 can output different signals as long as these signals are in the LPC domain. The actual mode of block 510 such as the excitation signal mode or the weighted signal mode can depend on the actual switch state. Alternatively, the block 510 can have two parallel processing devices. Hence, the LPC domain at the output of 510 can represent either the LPC excitation signal or the LPC weighted signal or any other LPC domain signal.

In the second encoding branch (ACELP/TCX) of FIG. 11*a* or 11*b*, the signal is pre-emphasized through a filter $1-0.68\ z^{-1}$ before encoding. At the ACELP/TCX decoder in FIG. 11B the synthesized signal is deemphasized with the filter $1/(1-0.68\ z^{-1})$. The preemphasis can be part of the LPC block 510 where the signal is preemphasized before LPC analysis and quantization. Similarly, deemphasis can be part of the LPC synthesis block $LPC^{-1}$ 540.

In an embodiment, the first switch 200 (see FIG. 11A) is controlled through an open-loop decision and the second switch is controlled through a closed-loop decision.

Exemplarily, there can be the situation that in the first processing branch, the first LPC domain represents the LPC excitation, and in the second processing branch, the second LPC domain represents the LPC weighted signal. That is, the first LPC domain signal is obtained by filtering through $(1-A(z))$ to convert to the LPC residual domain, while the second LPC domain signal is obtained by filtering through the filter $(1-A(z/\gamma))/(1-\mu z^{-1})$ to convert to the LPC weighted domain. In a mode, $\mu$ is equal to 0.68.

FIG. 11B illustrates a decoding scheme corresponding to the encoding scheme of FIG. 11A. The bitstream generated by bitstream multiplexer 800 of FIG. 11*a* is input into a bitstream demultiplexer 900. Depending on an information derived for example from the bitstream via a mode detection block 601, a decoder-side switch 600 is controlled to either forward signals from the upper branch or signals from the lower branch to the bandwidth extension block 701. The bandwidth extension block 701 receives, from the bitstream demultiplexer 900, side information and, based on this side information and the output of the mode decision 601, reconstructs the high band based on the low band output by switch 600.

The full band signal generated by block 701 is input into the joint stereo/surround processing stage 702, which reconstructs two stereo channels or several multi-channels. Generally, block 702 will output more channels than were input into this block. Depending on the application, the input into block 702 may even include two channels such as in a stereo mode and may even include more channels as long as the output by this block has more channels than the input into this block.

The switch 200 has been shown to switch between both branches so that only one branch receives a signal to process and the other branch does not receive a signal to process. In an alternative embodiment, however, the switch may also be arranged subsequent to for example the frequency-domain encoder 421 and the LPC domain encoder 510, 521, 526, 527, which means that both branches 400, 500 process the same signal in parallel. In order to not double the bitrate, however, only the signal output by one of those encoding branches 400 or 500 is selected to be written into the output bitstream. The decision stage will then operate so that the signal written into the bitstream minimizes a certain cost function, where the cost function can be the generated bitrate or the generated perceptual distortion or a combined rate/distortion cost function. Therefore, either in this mode or in the mode illustrated in the Figures, the decision stage can also operate in a closed loop mode in order to make sure that, finally, only the encoding branch output is written into the bitstream which has for a given perceptual distortion the lowest bitrate or, for a given bitrate, has the lowest perceptual distortion.

In the implementation having two switches, i.e., the first switch 200 and the second switch 521, it is advantageous that the time resolution for the first switch is lower than the time resolution for the second switch. Stated differently, the blocks of the input signal into the first switch, which can be switched via a switch operation are larger than the blocks switched by the second switch operating in the LPC-domain. Exemplarily, the frequency domain/LPC-domain switch 200 may switch blocks of a length of 1024 samples, and the second switch 521 can switch blocks having 256 or 512 samples each.

Generally, the audio encoding algorithm used in the first encoding branch 400 reflects and models the situation in an audio sink. The sink of an audio information is normally the human ear. The human ear can be modeled as a frequency analyzer. Therefore, the first encoding branch outputs encoded spectral information. The first encoding branch furthermore includes a psychoacoustic model for additionally applying a psychoacoustic masking threshold. This psychoacoustic masking threshold is used when quantizing audio spectral values where the quantization is performed such that a quantization noise is introduced by quantizing the spectral audio values, which are hidden below the psychoacoustic masking threshold.

The second encoding branch represents an information source model, which reflects the generation of audio sound. Therefore, information source models may include a speech model which is reflected by an LPC analysis stage, i.e., by transforming a time domain signal into an LPC domain and by subsequently processing the LPC residual signal, i.e., the excitation signal. Alternative sound source models, however, are sound source models for representing a certain instrument or any other sound generators such as a specific sound source existing in real world. A selection between different sound source models can be performed when several sound source models are available, for example based on an SNR calculation, i.e., based on a calculation, which of the source models is the best one suitable for encoding a certain time portion and/or frequency portion of an audio signal. However, the switch between encoding branches is performed in the time domain, i.e., that a certain time portion is encoded using one model and a certain different time portion of the intermediate signal is encoded using the other encoding branch.

Information source models are represented by certain parameters. Regarding the speech model, the parameters are LPC parameters and coded excitation parameters, when a modern speech coder such as AMR-WB+ is considered. The AMR-WB+ comprises an ACELP encoder and a TCX encoder. In this case, the coded excitation parameters can be global gain, noise floor, and variable length codes.

The audio input signal in FIG. 11A is present in a first domain which can, for example, be the time domain but which can also be any other domain such as a frequency domain, an LPC domain, an LPC spectral domain or any other domain. Generally, the conversion from one domain to the other domain is performed by a conversion algorithm such as any of the well-known time/frequency conversion algorithms or frequency/time conversion algorithms.

An alternative transform from the time domain, for example in the LPC domain is the result of LPC filtering a time domain signal which results in an LPC residual signal or excitation signal. Any other filtering operations producing a filtered signal which has an impact on a substantial number of signal samples before the transform can be used as a transform algorithm as the case may be. Therefore, weighting an audio signal using an LPC based weighting filter is a further transform, which generates a signal in the LPC domain. In a time/frequency transform, the modification of a single spectral value will have an impact on all time domain values before the transform. Analogously, a modification of any time domain sample will have an impact on each frequency domain sample. Similarly, a modification of a sample of the excitation signal in an LPC domain situation will have, due to the length of the LPC filter, an impact on a substantial number of samples before the LPC filtering. Similarly, a modification of a sample before an LPC transformation will have an impact on many samples obtained by this LPC transformation due to the inherent memory effect of the LPC filter.

FIG. 1A illustrates an embodiment for an apparatus for encoding an audio signal 10. The audio signal is introduced into a coding apparatus having a first encoding branch such as 400 in FIG. 11A for encoding the audio signal in a third domain which can, for example, be the straightforward frequency domain. The encoder furthermore can comprise a second encoding branch for encoding the audio signal based on a fourth domain which can be, for example, the LPC frequency domain as obtained by the TCX block 527 in FIG. 11A.

Figure 5:
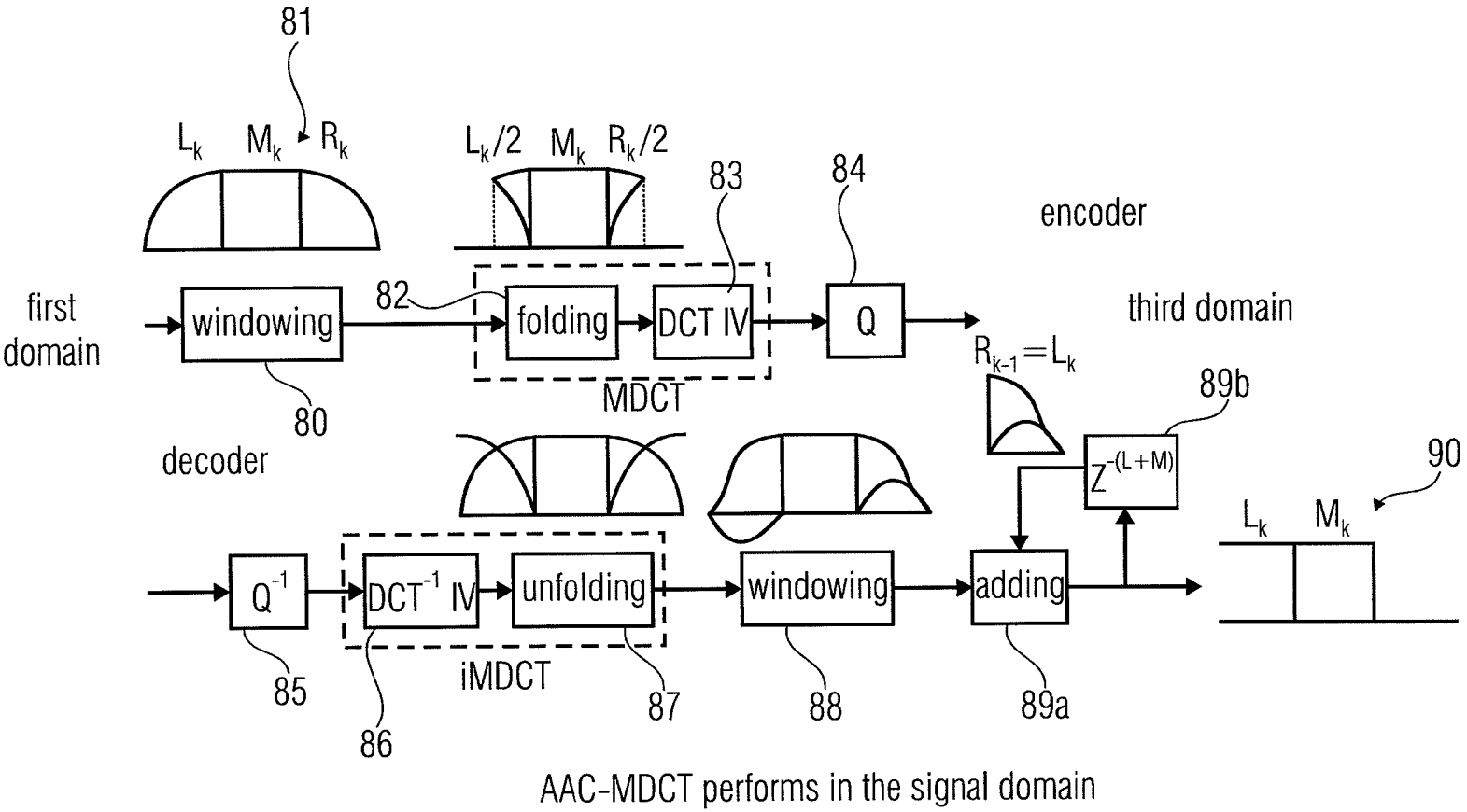
FIG. 5 is a schematic representation of an encoder and a decoder in one coding mode such as the AAC-MDCT coding mode.
Figure 8A:
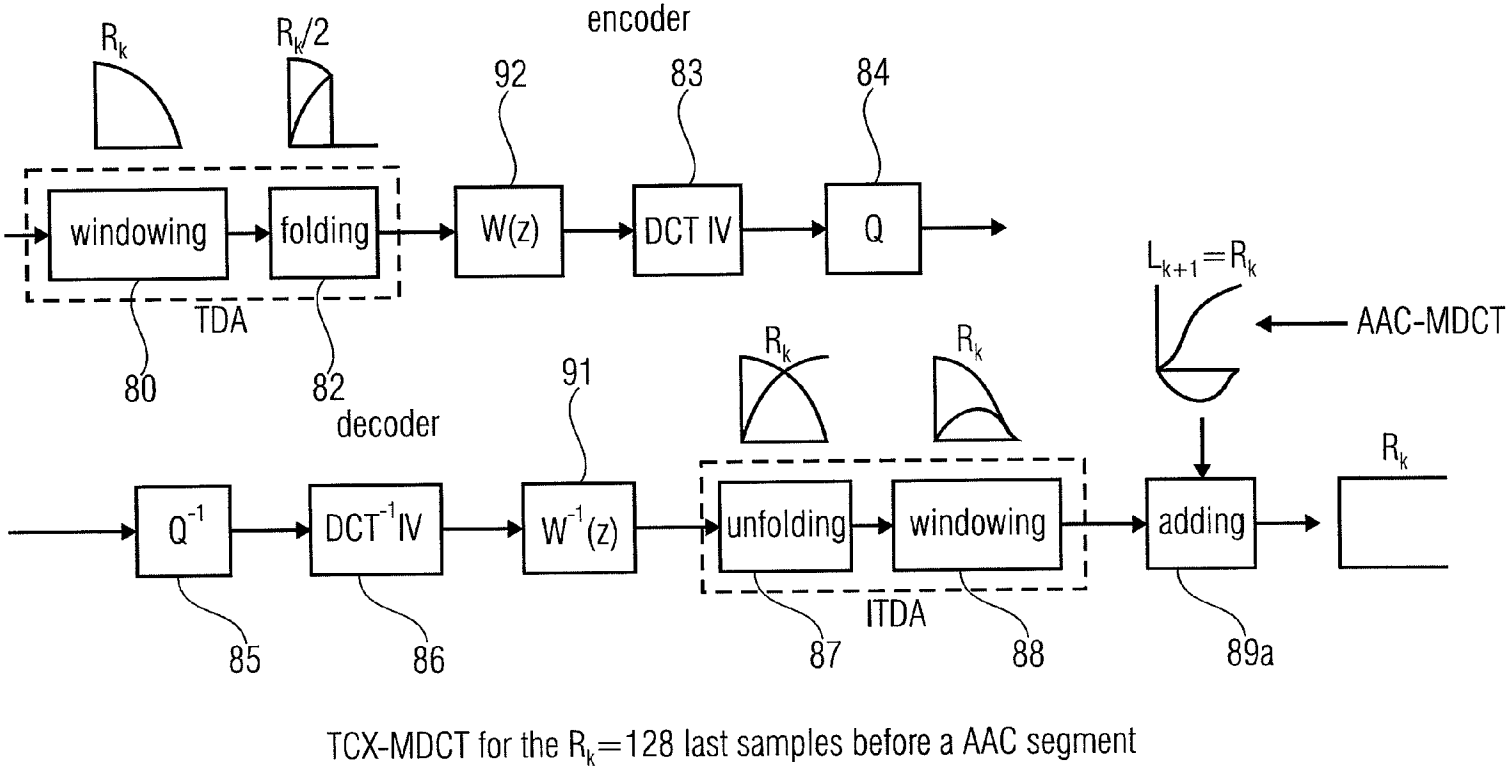
FIG. 8A is a representation of an embodiment for an encoder and a decoder in the context of switching from the TCX mode to the AAC mode.
Figure 8B:
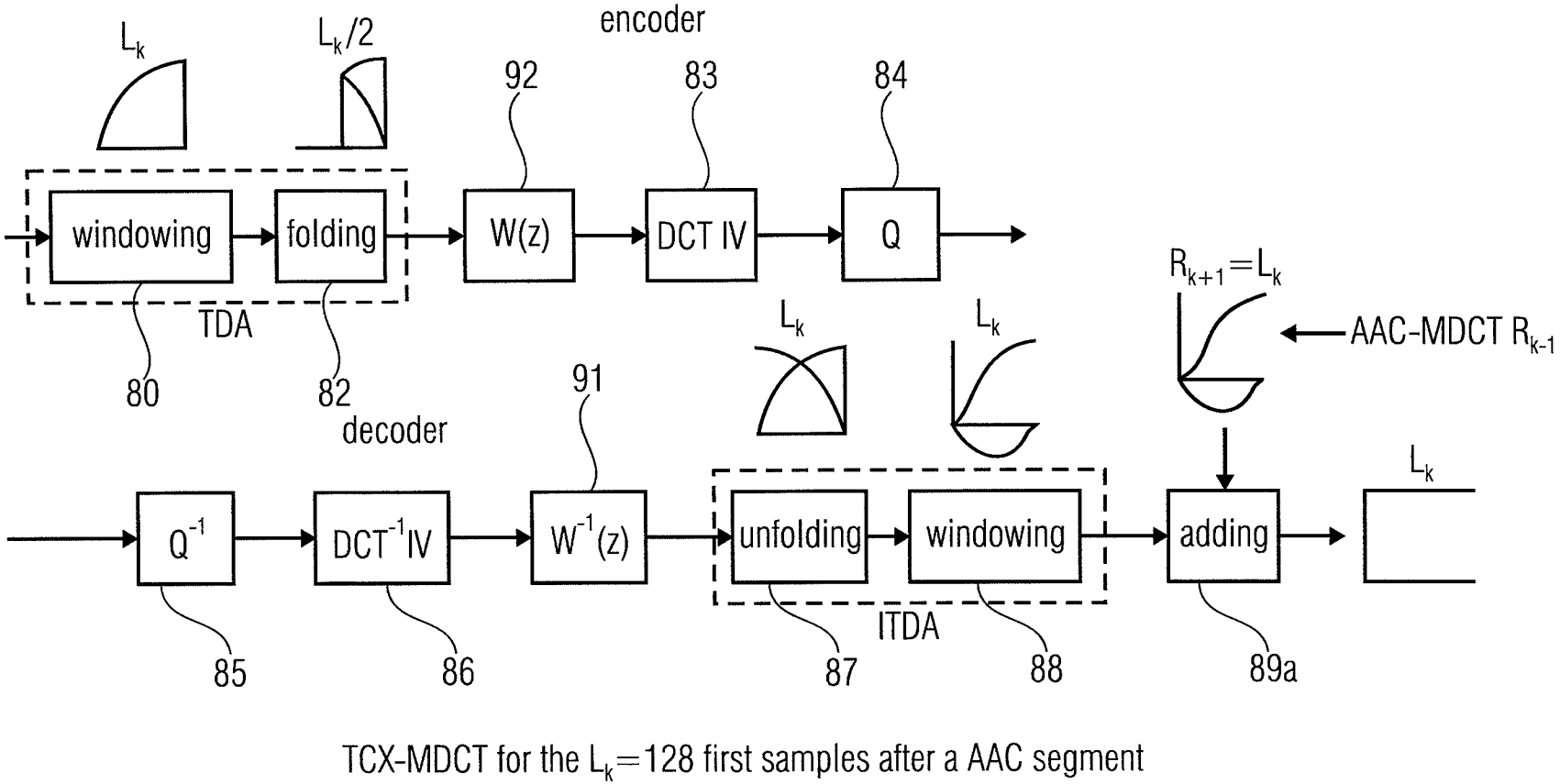
FIG. 8B is an embodiment for illustrating an encoder and a decoder for a transition from AAC to TCX.

The inventive apparatus comprises a windower 11 for windowing the first block of the audio signal in the first domain using a first analysis window having an analysis window shape, the analysis window having an aliasing portion such as $L_k$ or $R_k$ as discussed in the context of FIG. 8A and FIG. 8B or other figures, and having a non-aliasing portion such as $M_k$ illustrated in FIG. 5 or other figures.

The apparatus furthermore comprises a processor 12 for processing a first sub-block of the audio signal associated with the aliasing portion of the analysis window by transforming the sub-block from the first domain such as the signal domain or straightforward time domain into a second domain such as the LPC domain subsequent to windowing the first sub-block to obtain a processed first sub-block, and for processing a second sub-block of the audio signal associated with the further portion of the analysis window by transforming the second sub-block from the first domain such as the straightforward time domain into the second domain such as the LPC domain before windowing the second sub-block to obtain a processed second sub-block. The inventive apparatus furthermore comprises a transformer 13 for converting the processed first sub-block and the processed second sub-block from the second domain into the fourth domain such as the LPC frequency domain using the same block transform rule to obtain a converted first block. This converted first block can, then, be further processed in a further processing stage 14 to perform a data compression.

The further processing also receives, as an input, a second block of the audio signal in the first domain overlapping the first block, wherein the second block of the audio signal in the first domain such as the time domain is processed in the third domain, i.e., the straightforward frequency domain using a second analysis window. This second analysis window has an aliasing portion which corresponds to an aliasing portion of the first analysis window. The aliasing portion of the first analysis window and the aliasing portion of the second analysis window relate to the same audio samples of the original audio signal before windowing, and these portions are subjected to a time domain aliasing cancellation, i.e., an overlap-add procedure on the decoder side.

FIG. 1B illustrates the situation occurring, when transition from a block encoded in the fourth domain, for example the LPC frequency domain to a third domain such as the frequency domain takes place. In an embodiment, the fourth domain is the MDCT-TCX domain, and the third domain is the AAC domain. A window applied to the audio signal encoded in the MDCT-TCX domain has an aliasing portion 20 and a non-aliasing portion 21. The same block, which is named "first block" in FIG. 1B may or may not have a further aliasing portion 22. The same is true for the non-aliasing portion. It may or may not be present.

The second block of the audio signal coded in the other domain such as the AAC domain comprises a corresponding aliasing portion 23, and this second block may include further portions such as a non-aliasing portion or an aliasing portion as the case may be, which is indicated at 24 in FIG. 1B. Therefore, FIG. 1B illustrates an overlapping processing of the audio signal so that the audio samples in the aliasing portion 20 of the first block before windowing are identical to the audio samples in the corresponding aliasing portion 23 of the second block before windowing. Hence, the audio samples in the first block are obtained by applying an analysis window to the audio signal which is a stream of audio samples, and the second block is obtained by applying a second analysis window to a number of audio samples which include the samples in the corresponding aliasing portion 23 and the samples in the further portion 24 of the second block. Therefore, the audio samples in the aliasing portion 20 are the first block of the audio signal associated with the aliasing portion 20, and the audio samples in the further portion 21 of the audio signal correspond to the second sub-block of the audio signal associated with the further portion 21.

Figure 1C:
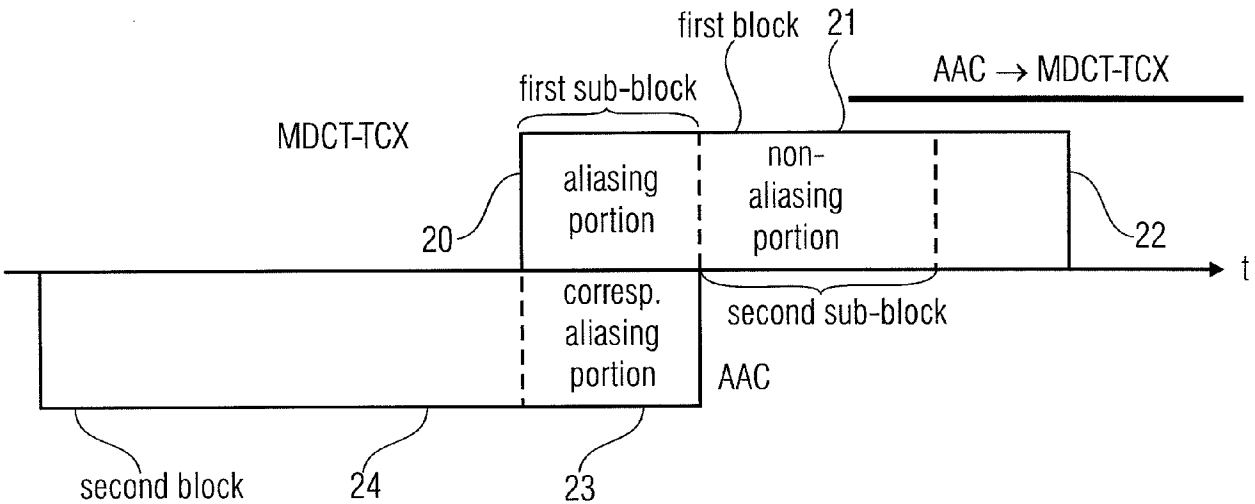
FIG. 1C is a schematic representation of a transition from AAC to MDCT-TCX.

FIG. 1C illustrates a similar situation as in FIG. 1B, but as a transition from AAC, i.e., the third domain into the MDCT-TCX domain, i.e., the fourth domain.

The difference between FIG. 1B and FIG. 1C is, in general, that the aliasing portion 20 in FIG. 1B includes audio samples occurring in time subsequent to audio samples in the further portion 21, while, in FIG. 1C, the audio samples in the aliasing portion 20 occur, in time, before the audio samples in the further portion 21.

Figure 1D:
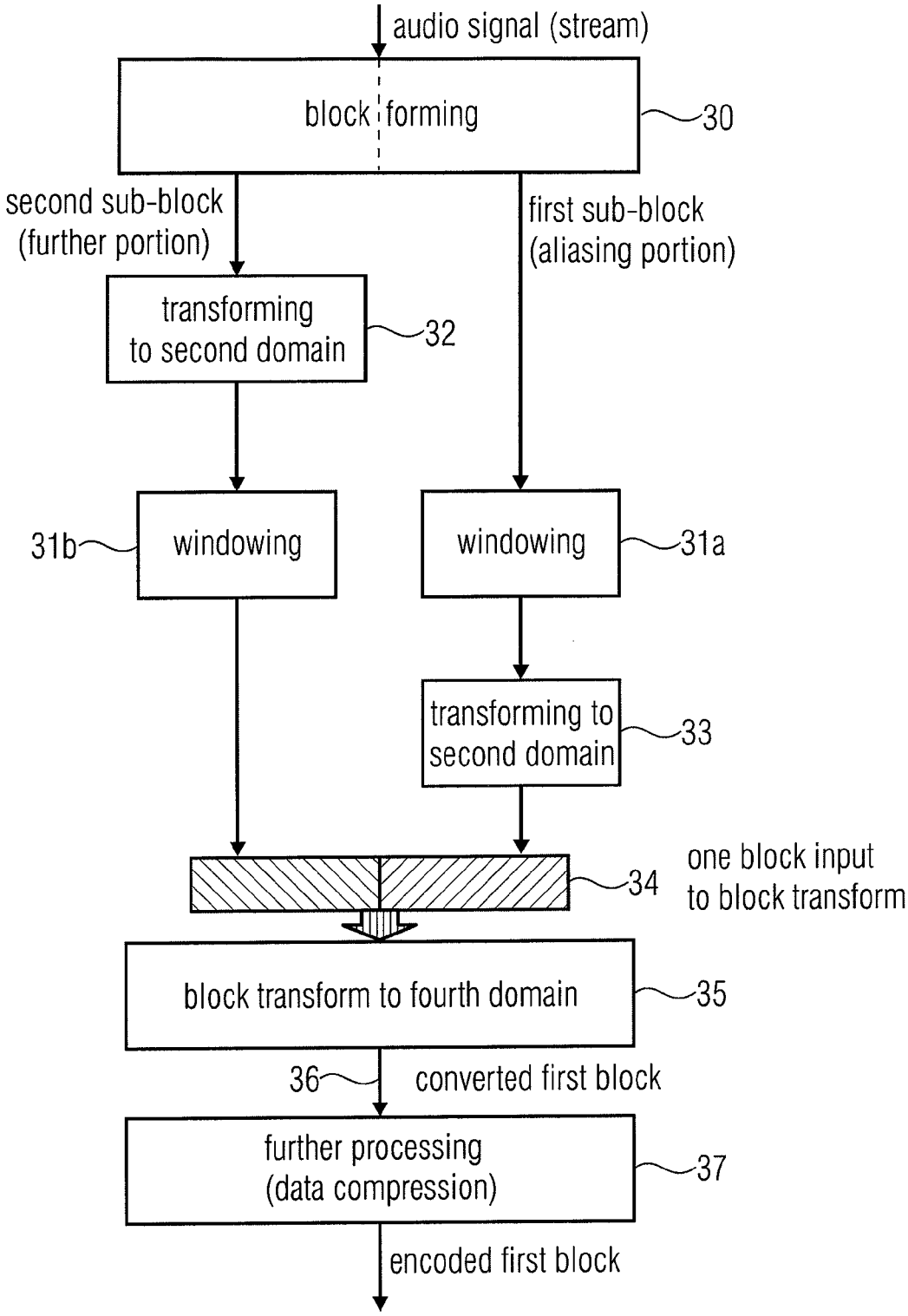
FIG. 1D is an illustration of an embodiment of the inventive concept as a flow chart.

FIG. 1D illustrates a detailed representation of the steps performed with the audio samples in the first sub-block and the second sub-block of one and same windowed block of audio samples. Generally, a window has an increasing portion and a decreasing portion, and depending on the window shape, there can be a relatively constant middle portion or not.

In a first step 30, a block forming operation is performed, in which a certain number of audio samples from a stream of audio samples is taken. Specifically, the block forming operation 30 will define, which audio samples belong to the first block and which audio samples belong to the second block of FIG. 1B and FIG. 1C.

The audio samples in the aliasing portion 20 are windowed in a step 31*a*. Importantly, however, the audio samples in the non-aliasing portion, i.e., in the second sub-block are transformed into the second domain, i.e., the LPC domain in the embodiment in step 32. Then, subsequent to transforming the audio samples in the second sub-block, the windowing operation 31*b* is performed. The audio samples claimed by the windowing operation 31*b* form the samples which are input into a block transform operation to the fourth domain illustrated in FIG. 1D as item 35.

The windowing operation in block 31*a*, 31*b* may or may not include a folding operation as discussed in connection with FIG. 8A, 8B, 9A, 10A. The windowing operation 31*a*, 31*b* additionally comprises a folding operation.

However, the aliasing portion is transformed into the second domain such as the LPC domain in block 33. Thus, the block of samples to be transformed into the fourth domain which is indicated at 34 is completed, and block 34 constitutes one block of data input into one block transform operation, such as a time/frequency operation. Since the second domain is, in the embodiment the LPC domain, the output of the block transform operation as in step 35 will be in the fourth domain, i.e., the LPC frequency domain. This block generated by block transform will be the converted first block 36, which is then first processed in step 37, in order to apply any kind of data compression which comprises, for example, the data compression operations applied to TCX data in the AMR-WB+ coder. Naturally, all other data compression operations can be performed as well in block 37. Therefore, block 37 corresponds to item 14 in FIG. 1A, and block 35 in FIG. 1D corresponds to item 13 in FIG. 1A, and the windowing operations correspond to 31*b* and 31*a* in FIG. 1D correspond to item 11 in FIG. 1A, and scheduling of the order between transforming and windowing which is different for the further portion and the aliasing portion is performed by the processor 12 in FIG. 1A.

FIG. 1D illustrates the case, in which the further portion consists of the non-aliasing sub-portion 21 and an aliasing sub-portion 22 of FIG. 1B or 1C. Alternatively, the further portion can only include an aliasing portion without a non-aliasing portion. In this case, 21 in FIGS. 1B and 1C would not be there and 22 would extend from the border of the block to the border of the aliasing portion 20. In any case, the further portion/further sub-block is processed in the same way (irrespective of being fully aliasing-free or fully aliasing or having an aliasing sub-portion and a non-aliasing sub-portion), but differently from the aliasing sub-block.

Figure 2:
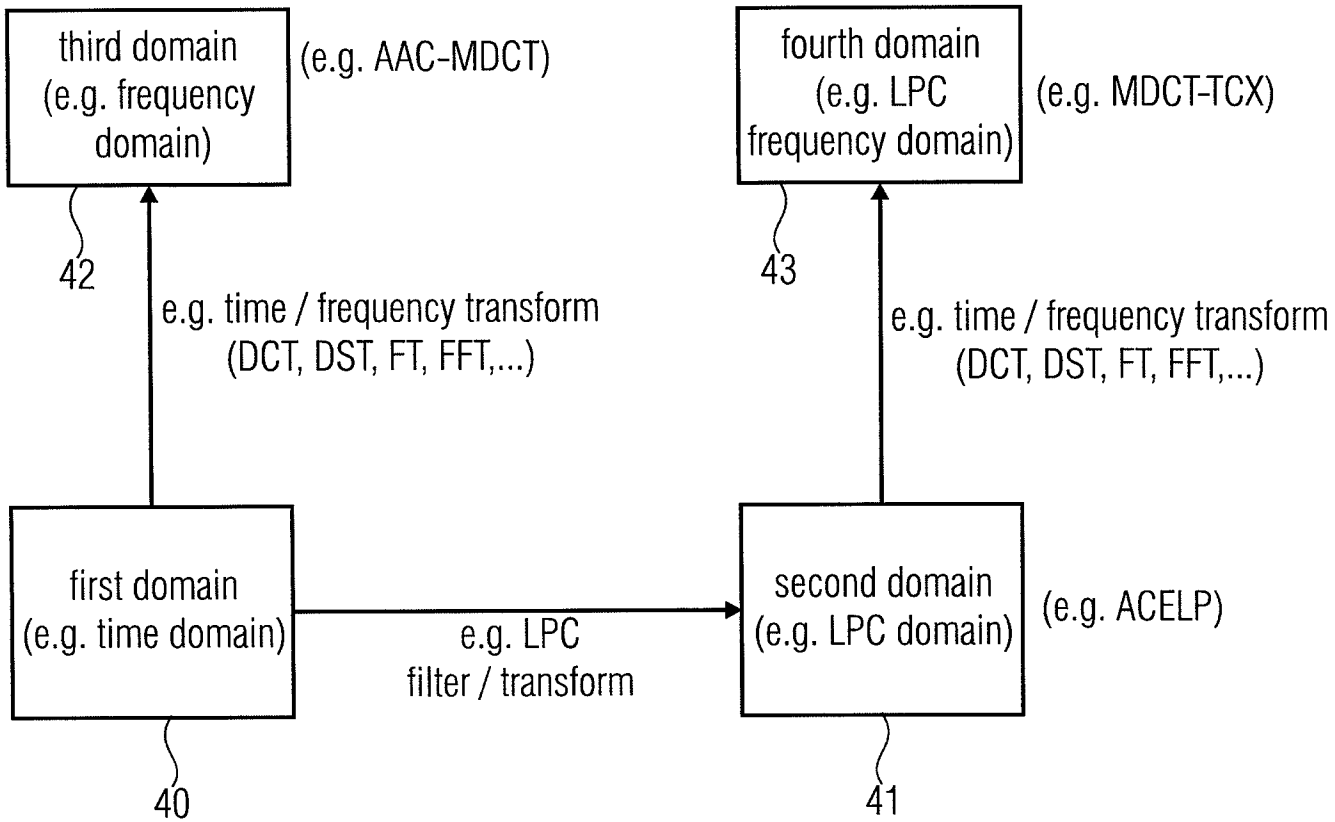
FIG. 2 is a schematic representation for illustrating four different domains and their relations, which occur in embodiments of the invention.

FIG. 2 illustrates an overview over different domains which occur in embodiments of the present invention.

Normally, the audio signal will be in the first domain 40 which can, for example, be the time domain. However, the invention actually applies to all situations, which occur when an audio signal is to be encoded in two different domains, and when the switch from one domain to the other domain has to be performed in a bit-rate optimum way, i.e., using critically sampling.

The second domain will be, in an embodiment, an LPC domain 41. A transform from the first domain to the second domain will be done via an LPC filter/transform as indicated in FIG. 2.

The third domain is, in an embodiment, the straightforward frequency domain 42, which is obtained by any of the well-known time/frequency transforms such as a DCT (discrete cosine transform), a DST (discrete sine transform), a Fourier transform or a fast Fourier transform or any other time/frequency transform.

Correspondingly, a conversion from the second domain into a fourth domain 43, such as an LPC frequency domain or, generally stated, the frequency domain with respect to the second domain 41 can also be obtained by any of the well-known time/frequency transform algorithms, such as DCT, DST, FT, FFT.

Then FIG. 2 is compared to FIG. 11A or 11B, the output of block 421 will have a signal in the third domain. Furthermore, the output of block 526 will have a signal in the second domain, and the output of block 527 will comprise a signal in the fourth domain. The other signal input into switch 200 or, generally, input into the decision stage 300 or the surround/joint stereo stage 101 will be in the first domain such as the time domain.

Figure 3A:
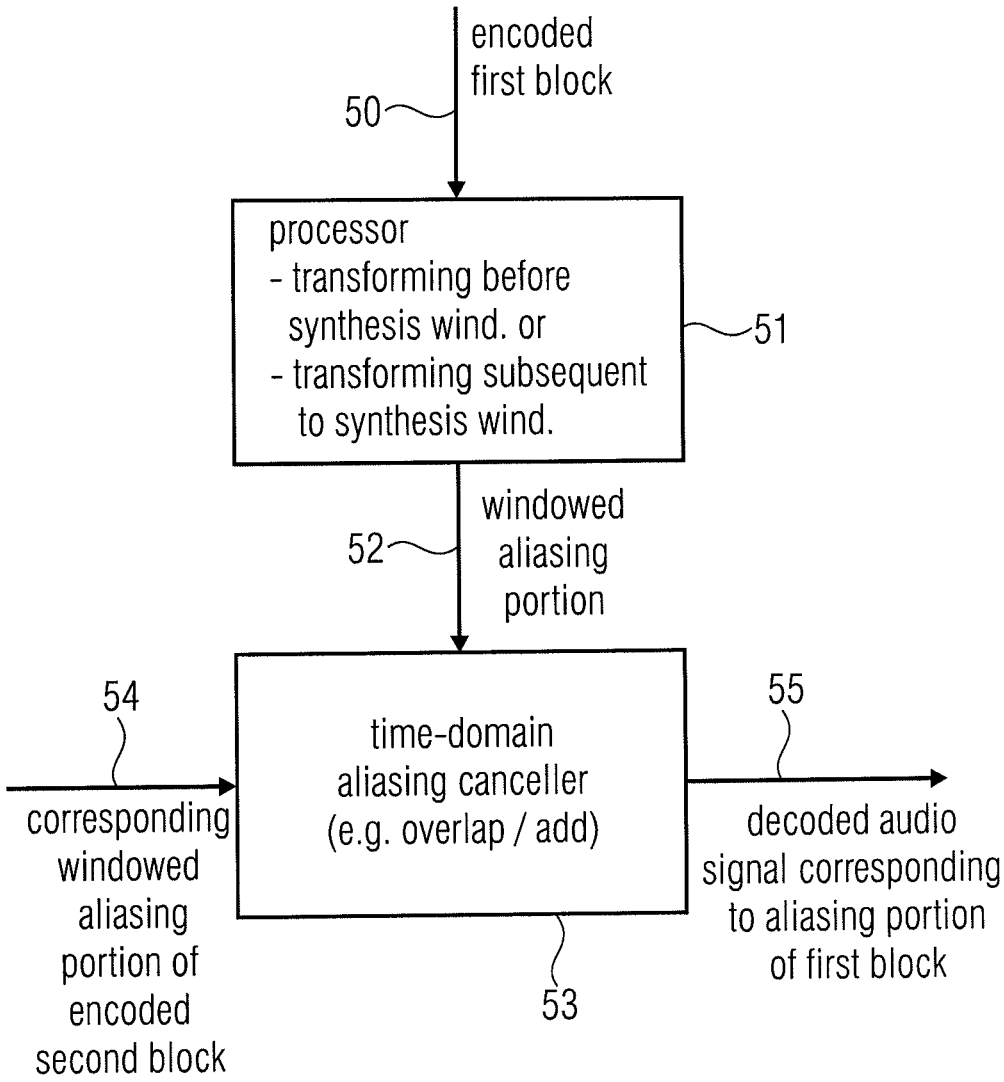
FIG. 3A is a scheme illustrating an inventive apparatus/method for decoding an audio signal.

FIG. 3A illustrates an embodiment of an inventive apparatus for decoding an encoded audio signal having an encoded first block 50 of audio data, where the encoded block has an aliasing portion and a further portion. The inventive decoder furthermore comprises a processor 51 for processing the aliasing portion by transforming the aliasing portion into a target domain for performing a synthesis windowing to obtain a windowed aliasing portion 52, and for performing a synthesis windowing of the further portion before performing a transform of the windowed further portion into the target domain.

Therefore, on the decoder side, portions of a block belonging to the same window are processed differently. A similar processing has been applied on the encoder side to allow a critically sampled switch over between different domains.

The inventive decoder furthermore comprises a time domain aliasing canceller 53 for combining the windowed aliasing portion of the first block, i.e., input 52, and a windowed aliasing portion of an encoded second block of audio data subsequent to a transform of the aliasing portion of the encoded second block into the target domain, in order to obtain a decoded audio signal 55, which corresponds to the aliasing portion of the first block. The windowed aliasing portion of the encoded second block is input via 54 into the time domain aliasing canceller 53.

A time domain aliasing canceller 53 is implemented as an overlap/add device, which, for example applies a 50% overlap. This means that the result of a synthesis window of one block is overlapped with the result of a synthesis window processing of an adjacent encoded block of audio data, where this overlap comprises 50% of the block. This means that the second portion of synthesis windowed audio data of an earlier block is added in a sample-wise manner to the first portion of a later second block of encoded audio data, so that, in the end, the decoded audio samples are the sum of corresponding windowed samples of two adjacent blocks. In other embodiments, the overlapping range can be more or less than 50%. This combining feature of the time domain aliasing canceller provides a continuous cross-fade from one block to the next, which completely removes any blocking artifacts occurring in any block-based transform coding scheme. Due to the fact that aliasing portions of different domains can be combined by the present invention, a critically sampled switching operation from a block of one domain to a block of the other domain is obtained.

Compared to a switch encoder without any cross-fading, in which a hard switch from one block to the other block is performed, the audio quality is improved by the inventive procedure, since the hard switch would inevitably result in blocking artifacts such as audible cracks or any other unwanted noise at the block border.

Compared to the non-critically sampled cross-fade, which indeed, would remove such an unwanted sharp noise at the block border, however, the present invention does not result in any data rate increase due to the switch. When, conventionally, the same audio samples would be encoded in the first block via the first coding branch and would be encoded in the second block via the second coding branch, a sample amount has been encoded in both coding branches would consume bit rate, when it would be processed without an aliasing introduction. In accordance with the present invention, however, an aliasing is introduced at the block borders. This aliasing-introduction which is obtained by a sample reduction, however, results in a possibility to apply a cross-fading operation by the time domain aliasing canceller 53 without the penalty of an increased bit rate or a non-critically sampled switchover.

In the most advantageous embodiment, a truly critically sampled switchover is performed. However, there can also be, in certain situations, less efficient embodiments, in which only a certain amount of aliasing is introduced and a certain amount of bit rate overhead is allowed. Due to the fact that aliasing portions are used and combined, however, all these less efficient embodiments are, nevertheless, better than a completely aliasing free transition with cross-fade or are with respect to quality, better than a hard switch from one encoding branch to the other encoding branch.

In this context, it is to be noted that the non-aliasing portion in TCX still produces critically sampled coded samples. Adding a non-aliasing portion in TCX does not compromise the critical sampling, but compromises the quality of the transition (lower handover) and the quality of the spectral representation (lower energy compaction). In view of this, it is advantageous to have the non-aliasing portion in TCX as small as possible or even close to zero so that the further portion is fully aliasing and does not have an aliasing-free sub-portion.

Subsequently, FIG. 3B will be discussed in order to illustrate an embodiment of the procedure in FIG. 3A.

In a step 56, the decoder processing of the encoded first block which is, for example, in the fourth domain, is performed. This decoder processing may be an entropy-decoding such as Huffman decoding or an arithmetic decoding corresponding to the further processing operations in block 14 of FIG. 1A on the encoder side. In step 57, a frequency/time conversion of the complete first block is performed as indicated at step 57. In accordance with FIG. 2, this procedure in step 57 results in a complete first block in the second domain. Now, in accordance with the present invention, the portions of the first block are processed differently. Specifically, the aliasing portion, i.e., the first sub-block of the output of step 57 will be transformed to the target domain before a windowing operation using a synthesis window is performed. This is indicated by the order of the transforming step 58*a* and the windowing step 59*a*. The second sub-block, i.e., the aliasing-free sub-block is windowed using a synthesis window as indicated at 59*b*, as it is, i.e., without the transforming operation in item 58*a* in FIG. 3B. The windowing operation in block 59*a* or 59*b* may or may not comprise a folding (unfolding) operation. Advantageously, however, the windowing operation comprises a folding (unfolding operation).

Depending on whether the second sub-block corresponding to the further portion is indeed an aliasing sub-block or a non-aliasing sub-block, the transforming operation into the target domain as indicated at 58*b* is performed without any TDAC operation/combining operation in the case of the second sub-block being a non-aliasing sub-block. When, however, the second sub-block is an aliasing sub-block, a TDAC operation, i.e., a combining operation 60*b* is performed with a corresponding portion of another block, before the transforming operation into the target domain in step 58*b* is obtained to calculate the decoded audio signal for the second block.

In the other branch, i.e., for the aliasing portion corresponding to the first sub-block, the result of the windowing operation in step 59*a* is input into a combining stage 60*a*. This combining stage 60*a* also receives, as an input, the aliasing portion of the second block, i.e., the block which has been encoded in the other domain, such as the AAC domain in the example of FIG. 2. Then, the output of block 60*a* constitutes the decoded audio signal for the first sub-block.

Figure 3B:
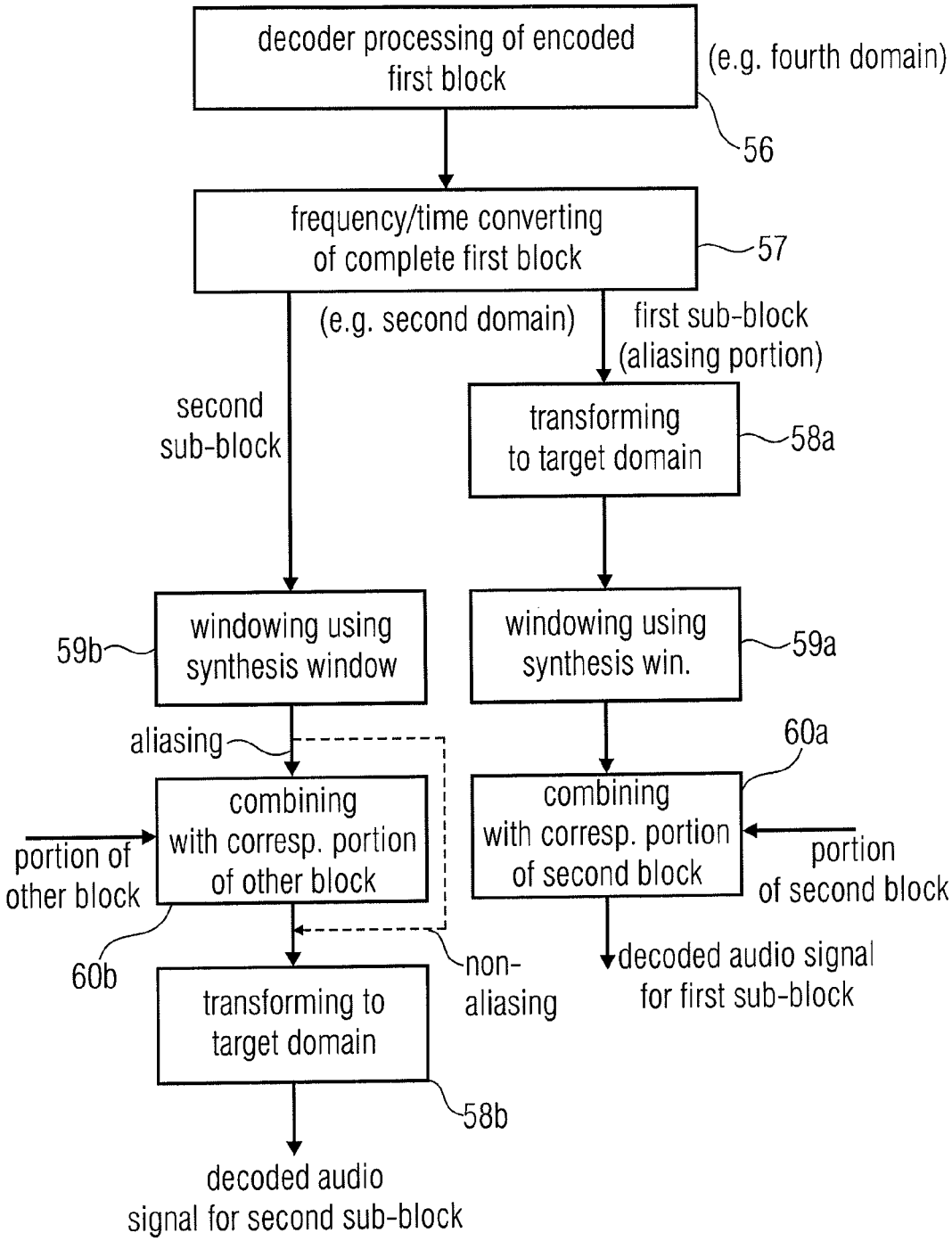
FIG. 3B is a further illustration of decoding schemes in accordance with embodiments of the present invention.

When, FIG. 3A and FIG. 3B are compared, it becomes clear that the combining operation 60*a* corresponds to the processing performed in the block 53 of FIG. 3A. Furthermore, the transforming operation and the windowing operation performed by the processor 51 corresponds to items 58*a*, 58*b* with respect to the transforming operation and 59*a* and 59*b* with respect to the windowing operation, where the processor 51 in FIG. 3A furthermore insures that the correct order for the aliasing portion and the other portion, i.e., the second sub-block, is maintained.

In the embodiment, the modified discrete cosine transform (MDCT) is applied in order to obtain the critically sampling switchover from an encoding operation in one domain to an encoding operation in a different other domain. However, all other transforms can be applied as well. Since, however, the MDCT is the advantageous embodiment, the MDCT will be discussed in more detail with respect to FIG. 4A and FIG. 4B.

FIG. 4A illustrates a window 70, which has an increasing portion to the left and a decreasing portion to the right, where one can divide this window into four portions: a, b, c, and d. Window 70 has, as can be seen from the figure only aliasing portions in the 50% overlap/add situation illustrated. Specifically, the first portion having samples from zero to N corresponds to the second portions of a preceding window 69, and the second half extending between sample N and sample 2N of window 70 is overlapped with the first portion of window 71, which is in the illustrated embodiment window i+1, while window 70 is window i.

The MDCT operation can be seen as the cascading of the folding operation and a subsequent transform operation and, specifically, a subsequent DCT operation, where the DCT of type-IV (DCT-IV) is applied. Specifically, the folding operation is obtained by calculating the first portion N/2 of the folding block as $-c_R-d$, and calculating the second portion of N/2 samples of the folding output as $a-b_R$, where R is the reverse operator. Thus, the folding operation results in N output values while 2N input values are received.

A corresponding unfolding operation on the decoder-side is illustrated, in equation form, in FIG. 4A as well.

Generally, an MDCT operation on (a, b, c, d) results in exactly the same output values as the DCT-IV of $(-c_R-d, a-b_R)$ as indicated in FIG. 4A.

Correspondingly, and using the unfolding operation, an IMDCT operation results in the output of the unfolding operation applied to the output of a DCT-IV inverse transform.

Therefore, time aliasing is introduced by performing a folding operation on the encoder-side. Then, the result of the folding operation is transformed into the frequency domain using a DCT-IV block transform necessitating N input values.

On the decoder-side, N input values are transformed back into the time domain using a $\text{DCT-IV}^{-1}$ operation, and the output of this inverse transform operation is thus changed into an unfolding operation to obtain 2N output values which, however, are aliased output values.

In order to remove the aliasing which has been introduced by the folding operation and which is still there subsequent to the unfolding operation, the overlap/add operation by the time domain aliasing canceller 53 of FIG. 3A is necessitated.

Therefore, when the result of the unfolding operation is added with the previous IMDCT result in the overlapping half, the reversed terms cancel in the equation in the bottom of FIG. 4A and one obtains simply, for example, b and d, thus recovering the original data.

In order to obtain a TDAC for the windowed MDCT, a requirement exists, which is known as "Princen-Bradley" condition, which means that the window coefficients raised to $^2$ for the corresponding samples which are combined in the time domain aliasing canceller as to result in unity (1) for each sample.

Figure 4B:
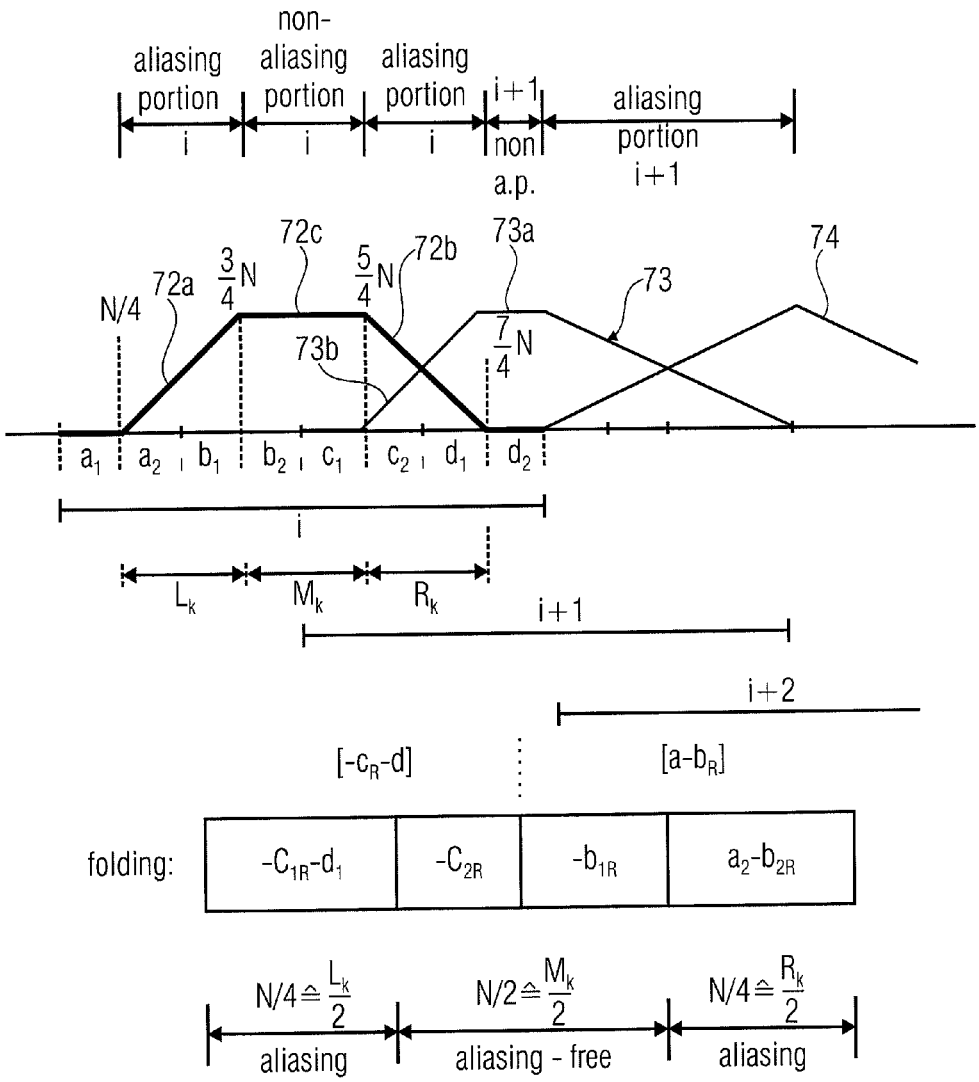
FIG. 4B illustrates window functions comparable to the window function in FIG. 4A, but with an aliasing portion and a non-aliasing portion.

While FIG. 4A illustrates the window sequence as, for example, applied in the AAC-MDCT for long windows or short windows, FIG. 4B illustrates a different window function which has, in addition to aliasing portions, a non-aliasing portion as well.

FIG. 4B illustrates an analysis window function 72 having a zero portion $a_1$ and $d_2$, having an aliasing portion 72*a*, 72*b*, and having a non-aliasing portion 72*c*.

The aliasing portion 72*b* extending over $c_2$, $d_1$ has a corresponding aliasing portion of a subsequent window 73, which is indicated at 73*b*. Correspondingly, window 73 additionally comprises a non-aliasing portion 73*a*. FIG. 4B, when compared to FIG. 4A makes clear that, due to the fact that there are zero portions $a_1$, $d_2$, for window 72 or $c_1$ for window 73, both windows receive a non-aliasing portion, and the window function in the aliasing portion is steeper than in FIG. 4A. In view of that, the aliasing portion 72*a* corresponds to $L_k$, the non-aliasing portion 72*c* corresponds to portion $M_k$, and the aliasing portion 72*b* corresponds to $R_k$ in FIG. 4B.

When the folding operation is applied to a block of samples windowed by window 72, a situation is obtained as illustrated in FIG. 4B. The left portion extending over the first N/4 samples has aliasing. The second portion extending over N/2 samples is aliasing-free, since the folding operation is applied on window portions having zero values, and the last N/4 samples are, again, aliasing-affected. Due to the folding operation, the number of output values of the folding operation is equal to N, while the input was 2N, although, in fact, N/2 values in this embodiment were set to zero due to the windowing operation using window 72.

Now, the DCT IV is applied to the result of the folding operation, but, importantly, the aliasing portion 72 which is at the transition from one coding mode to the other coding mode is differently processed than the non-aliasing portion, although both portions belong to the same block of audio samples and, importantly, are input into the same block transform operation performed by the transformer 13 in FIG. 1A.

FIG. 4B furthermore illustrates a window sequence of windows 72, 73, 74, where the window 73 is a transition window from a situation where there does exist non-aliasing portions to a situation, where only exist aliasing portions. This is obtained by asymmetrically shaping the window function. The right portion of window 73 is similar to the right portion of the windows in the window sequence of FIG. 4A, while the left portion has a non-aliasing portion and the corresponding zero portion (at $c_1$). Therefore, FIG. 4B illustrates a transition from MDCT-TCX to AAC, when AAC is to be performed using fully-overlapping windows or, alternatively, a transition from AAC to MDCT-TCX is illustrated, when window 74 windows a TCX data block in a fully-overlapping manner, which is the regular operation for MDCT-TCX on the one hand and MDCT-AAC on the other hand when there is no reason for switching from one mode to the other mode.

Therefore, window 73 can be termed to be a "start window" or a "stop window", which has, in addition, the characteristic that the length of this window is identical to the length of at least one neighboring window so that the general block raster or frame raster is maintained, when a block is set to have the same number as window coefficients, i.e., 2N samples in the FIG. 4B or FIG. 4A example.

Subsequently, the AAC-MDCT procedure on the encoder-side and on the decoder-side is discussed with respect to FIG. 5.

In a windowing operation 80, a window function is illustrated at 81 is applied. The window function has two aliasing portions $L_k$ and $R_k$, and a non-aliasing portion $M_k$. Therefore, the window function 81 is similar to the window function 72 in FIG. 4B. Applying this window function to a corresponding plurality of audio samples results in the windowed block of audio samples having an aliasing sub-block corresponding to $R_k/L_k$ and a non-aliasing sub-block corresponding to $M_k$.

The folding operation illustrated by 82 is performed as indicated in FIG. 4B and results in N outputs, which means that the portions $L_k$, $R_k$ are reduced to have a smaller number of samples.

Then, a DCT IV 83 is performed as discussed in connection with the MDCT equation in FIG. 4A. The MDCT output is further processed by any available data compressor such as a quantizer 84 or any other device performing any of the well-known AAC tools.

On the decoder side, an inverse processing 85 is performed. Then, a transform from the third domain into the first domain is performed via the $DCT^{-1}$ IV 86. Then, an unfolding operation 87 is performed as discussed in connection with FIG. 4A. Then, in a block 88, a synthesis windowing operation is performed, and items 89*a* and 89*b* together perform a time domain aliasing cancellation. Item 89*b* is a delay device applying a delay of $M_k+R_k$ samples in order to obtain the overlap as discussed in connection with FIG. 4A, and adder 89*a* performs a combination of the current portion of the audio samples such as the first portion $L_k$ of a current window output and the last portion $R_{k-1}$ of the previous window. This results, as indicated at 90, in aliasing-free portions $L_k$ and $M_k$. It is to be noted that $M_k$ was aliasing-free from the beginning, but the processing by the devices 89*a*, 89*b* has cancelled the aliasing in the aliasing portion $L_k$.

In the embodiment, the AAC-MDCT can also be applied with windows only having aliasing portions as indicated in FIG. 4A, but, for a switch between one coding mode to the other coding mode, it is advantageous that an AAC window having an aliasing portion and having a non-aliasing portion is applied.

An embodiment of the present invention is used in a switched audio coding which switches between AAC and AMR-WB+[4].

AAC uses a MDCT as described in FIG. 5. AAC is very well suited for music signal. The switched coding uses AAC when the input signal is detected in a previous processing as music or labeled as music by the user.

The input signal frame k is windowed by a three parts window of sizes $L_k$, $M_k$ and $R_k$. The MDCT introduces time-domain aliasing components before transforming the signal in frequency domain where the quantization is performed. After adding the overlapped previous windowed signal of size $R_{k-1}=L_k$, the $L_k+M_k$ first samples of original signal frame could be recovered if any quantization error was introduced. The time-domain aliasing is cancelled.

Subsequently, the TCX-MDCT procedure with respect to the present invention is discussed in connection with FIG. 6.

In contrast to the encoder in FIG. 5, a transform into the second domain is performed by item 92. Item 92 is an LPC transformer either generating an LPC residual signal or a weighted signal which can be calculated by weighting an LPC residual signal using a weighting filter as known from TCX processing. Naturally, the TCX signal can also be calculated with a single filter by filtering the time domain signal in order to obtain the TCX signal, which is a signal in the LPC domain or, generally stated, in the second domain. Therefore, the first domain/second domain converter 92 provides, at its output site, the signal input into the windowing device 80. Apart from the transformer 92, the procedure in the encoder in FIG. 6 is similar to the procedure in the encoder of FIG. 5. Naturally, one can apply different data compression algorithms in blocks 84 in FIG. 5 and FIG. 6, which are readily apparent, when the AAC coding tools are compared to the TCX coding tools.

On the decoder side, the same steps as discussed in connection with FIG. 5 are performed, but these steps are not performed on an encoded signal in the straightforward frequency domain (third domain), but are performed on a coded signal which is generated in the fourth domain, i.e., the LPC frequency domain.

Figure 6:
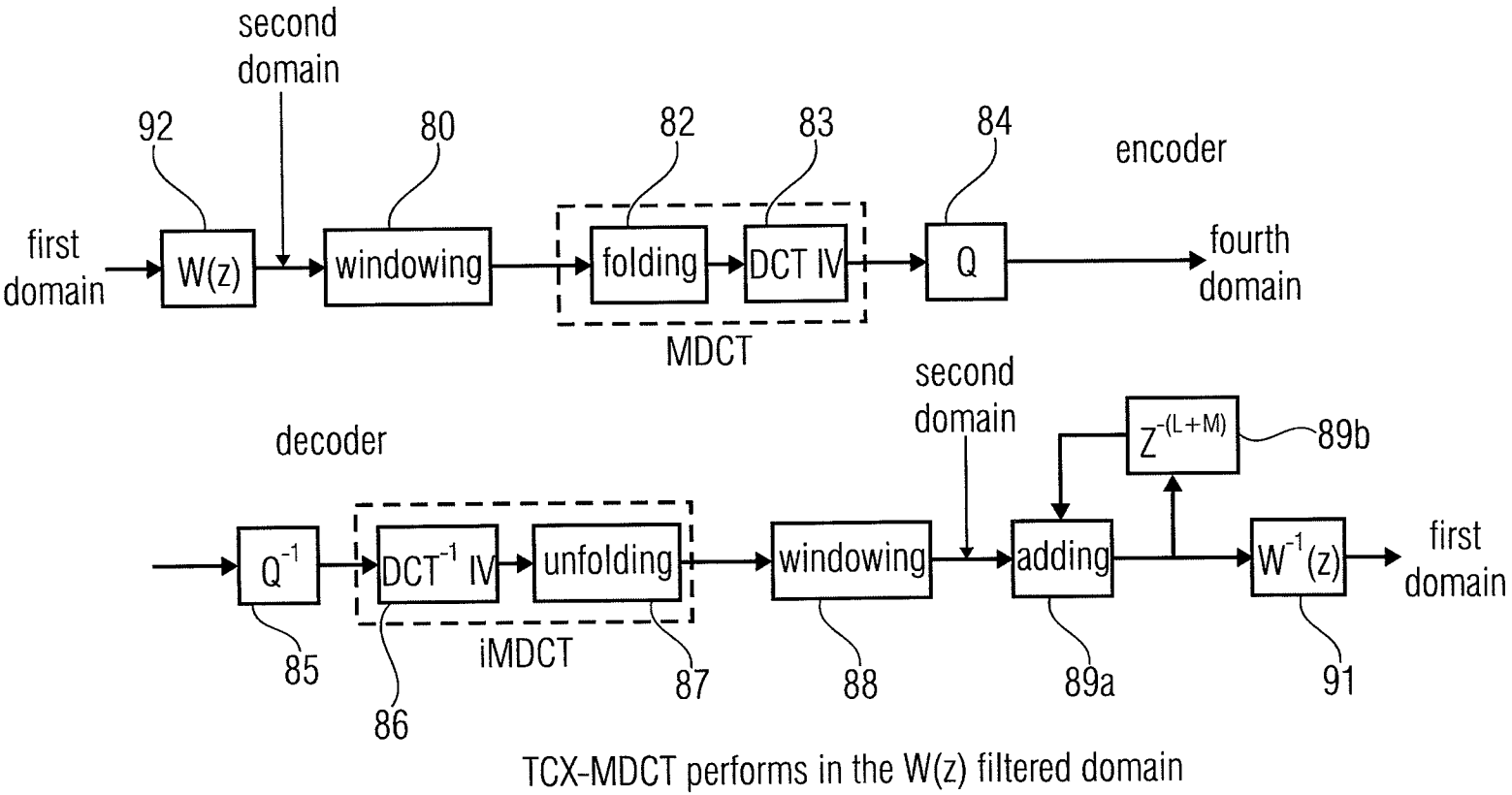
FIG. 6 is a representation of an encoder and a decoder applying MDCT in a different domain such as the LPC domain in the context of TCX encoding in AMR-WB+.

Therefore, the overlap add procedure by devices 89*a*, 89*b* in FIG. 6 is performed in the second domain rather than in the first domain as illustrated in FIG. 5.

AMR-WB+ is based on a speech coding ACELP and a transform-based coding TCX. For each super-frame of 1024 samples, AMR-WB+ selects with closed-loop decision between 17 different combinations of TCX and ACELP, the best one according to closed-decision using the SegSNR objective evaluation. The AMR-WB+ is well-suited for speech and speech over music signals. The original DFT of the TCX was replaced by a MDCT in order to enjoy its great properties. The TCX of AMR-WB+ is then equivalent to the MTPC coding excepting for the quantization which was kept as it is. The modified AMR-WB+ is used by the switched audio coder when the input signal is detected or labeled as speech or speech over music.

The TCX-MDCT performs a MDCT not directly on the signal domain but after filtering the signal by a analysis filter W(z) based on an LPC coefficient. The filter is called weighting analysis filter and permits the TCX in the same time to whiten the signal and to shape the quantization noise by a formant-based curve which is in line with psycho-acoustic theories.

Figure 7:
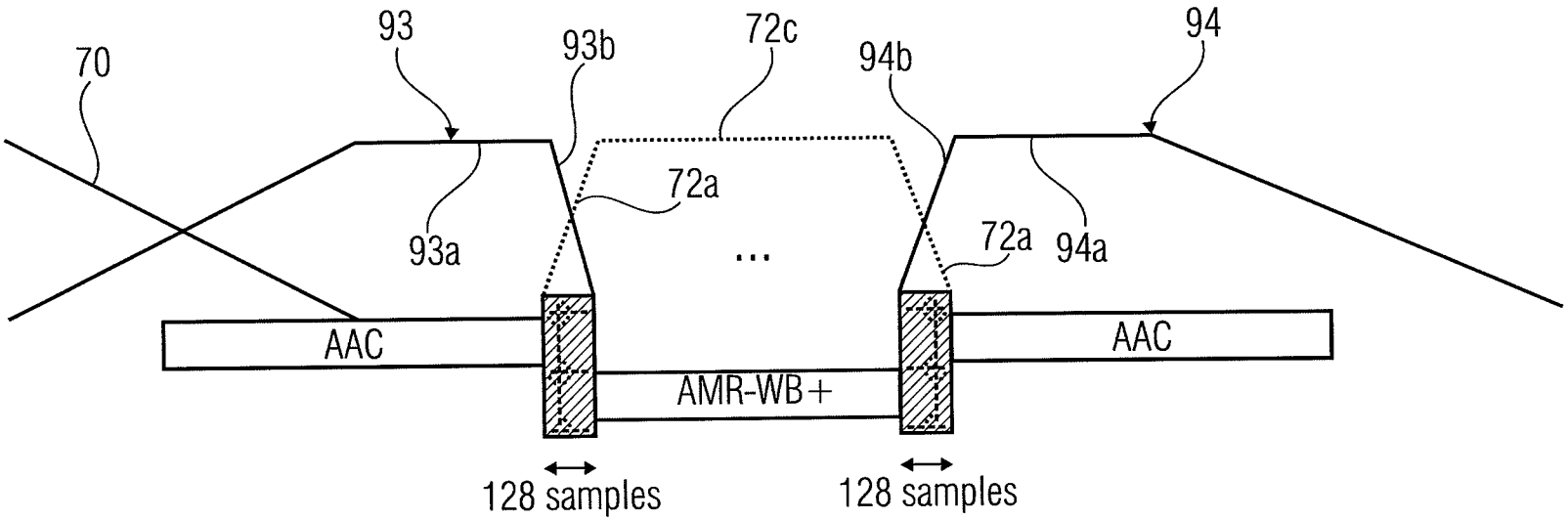
FIG. 7 is a specific sequence of windows for transitions between AAC and AMR-WB+.

The processing illustrated in FIG. 5 is performed for a straightforward AAC-MDCT mode without any switching to TCX mode or any other mode using the fully overlapping windows in FIG. 4A. When, however, a transition is detected, a specific window is applied, which is an AAC start window for a transition to the other coding mode or an AAC stop window for the transition from the other coding mode into the AAC mode as illustrated in FIG. 7. An AAC stop window 93 has an aliasing portion illustrated at 93*b* and a non-aliasing portion illustrated at 93*a*, i.e., indicated in the figure as the horizontal part of the window 93. Correspondingly, the AAC stop window 94 is illustrated as having an aliasing portion 94*b* and a non-aliasing portion 94*a*. In the AMR-WB+ portion, a window is applied similar to window 72 of FIG. 4B, where this window has an aliasing portion 72*a* and a non-aliasing portion 72*c*. Although only a single AMR-WB+ window which can be seen as a start/stop window as illustrated in FIG. 7, there can be a plurality of windows which have a 50% overlapping and can, therefore, be similar to the windows in FIG. 4A. Usually TCX in AMR-WB+ does not use any 50% overlap. Only a small overlap is adopted for being able to switch promptly to/from ACELP which uses inherently rectangular window, i.e. 0% of overlap.

However, when the transition takes place, an AMR-WB+ start window is applied illustrated at the left center position in FIG. 7, and when it is decided that the transition from AMR-WB+ to AAC is to be performed, an AMR-WB+ stop window is applied. The start window has an aliasing portion to the left and the stop window has an aliasing portion to the right, where these aliasing portions are indicated as 72*a*, and where these aliasing portions correspond to the aliasing portions of the neighboring AAC start/stop windows indicated at 93*b* or 94*b*.

The specific processing occurs in the two overlapped regions of 128 samples of FIG. 7. For canceling the time-domain aliasing of AAC, the first and the last frames of the AMR-WB+ segment are forced to be TCX and not ACELP. This is done by biasing the SegSNR score in the closed-loop decision. Furthermore the first 128 samples of the TCX-MDCT are processed specifically as illustrated in FIG. 8A, where $L_k$=128.

The last 128 samples of AMR-WB+ are processed as illustrated in the FIG. 8B, where $R_k$=128.

FIG. 8A illustrates the processing for the aliasing portion $R_k$ to the right of the non-aliasing portion for a transition from TCX to AAC, and FIG. 8B illustrates the specific processing of the aliasing portion $L_k$ to the left of a non-aliasing portion for a transition from AAC to TCX. The processing is similar with respect to FIG. 6, but the weighting operation, i.e., the transform from the first domain to the second domain is positioned differently. Specifically, in FIG. 6, the transform is performed before windowing, while, in FIG. 8B, the transform 92 is performed subsequent to the windowing 80 (and the folding 82), i.e., the time domain aliasing introducing operation indicated by "TDA".

On the decoder side, again, quite similar processing steps as in FIG. 6 are performed, but, again, the position of the inverse weighting for the aliasing portion is before windowing 88 (and before unfolding 87) and subsequent to the transform from the first domain to the second domain indicated by 86 in FIG. 8A.

Therefore, in accordance with an embodiment of the present invention, the aliasing portion of a transition window for TCX is processed as indicated in FIG. 1A or FIG. 1B, and a non-aliasing portion for the same window is processed in accordance with FIG. 6.

The processing for any AAC-MDCT window remains the same apart from the fact that a start window or a stop window is selected at the transition. In other embodiments, however, the TCX processing can remain the same and the aliasing portion of the AAC-MDCT window is processed differently compared to the non-aliasing portion.

Furthermore, both aliasing portions of both windows, i.e., an AAC window or a TCX window can be processed differently from their non-aliasing portions as the case may be. In the embodiment, however, it is advantageous that the AAC processing is done as it is, since it is already in the signal domain subsequent to the overlap-add procedure as is clear from FIG. 5, and that the TCX transition window is processed as illustrated in the context of FIG. 6 for a non-aliasing portion and as illustrated in FIG. 8A or 8B for the aliasing portion.

Subsequently, FIG. 9A will be discussed, in which the processor 12 of FIG. 1A has been indicated as a controller 98.

Figure 9A:
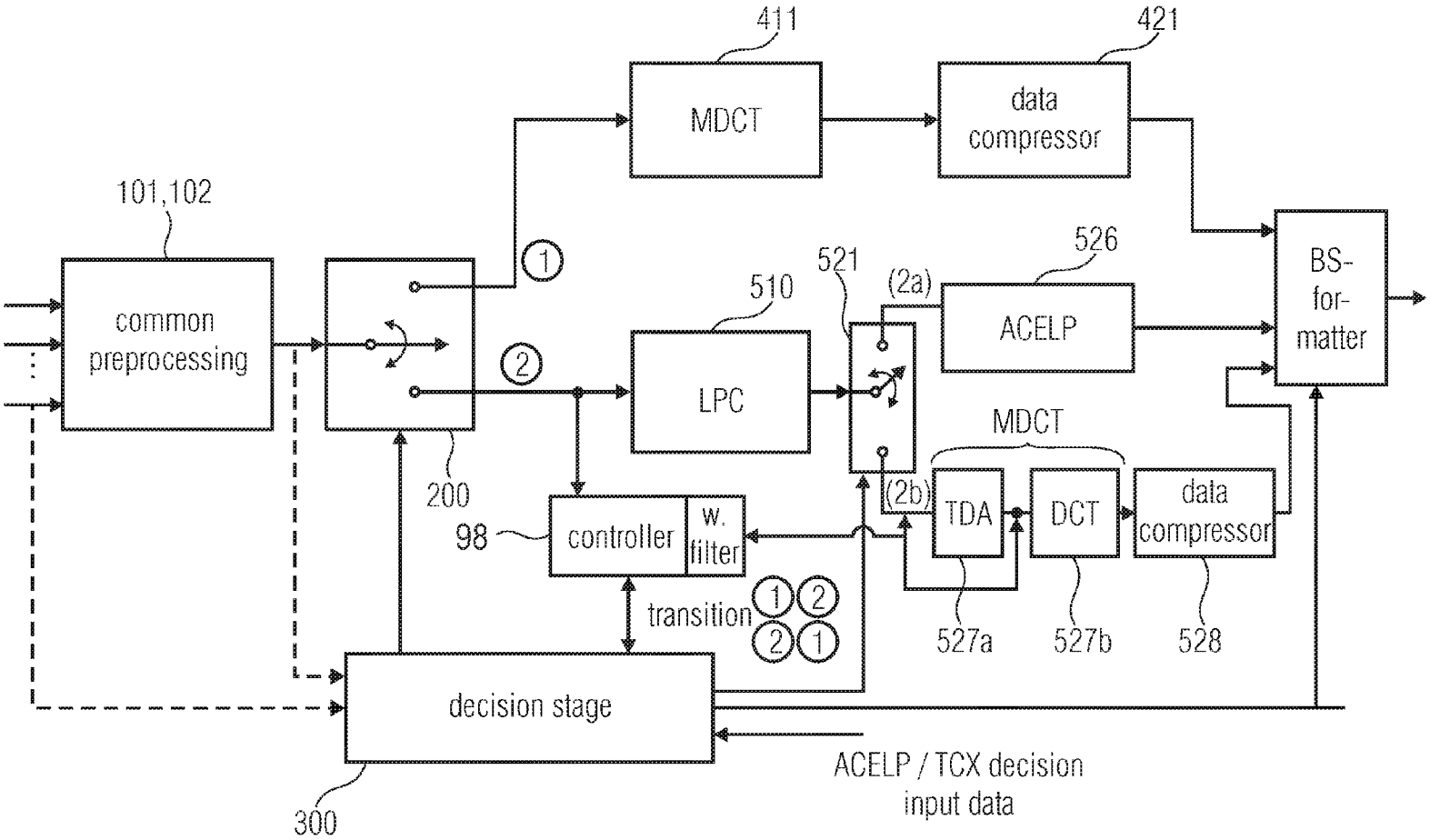
FIG. 9A is a block diagram of a hybrid switched coding scheme, in which the present invention is applied.

Devices in FIG. 9A having corresponding reference numerals which correspond to items of FIG. 11A have a similar functionality and are not discussed again.

Figure 9B:
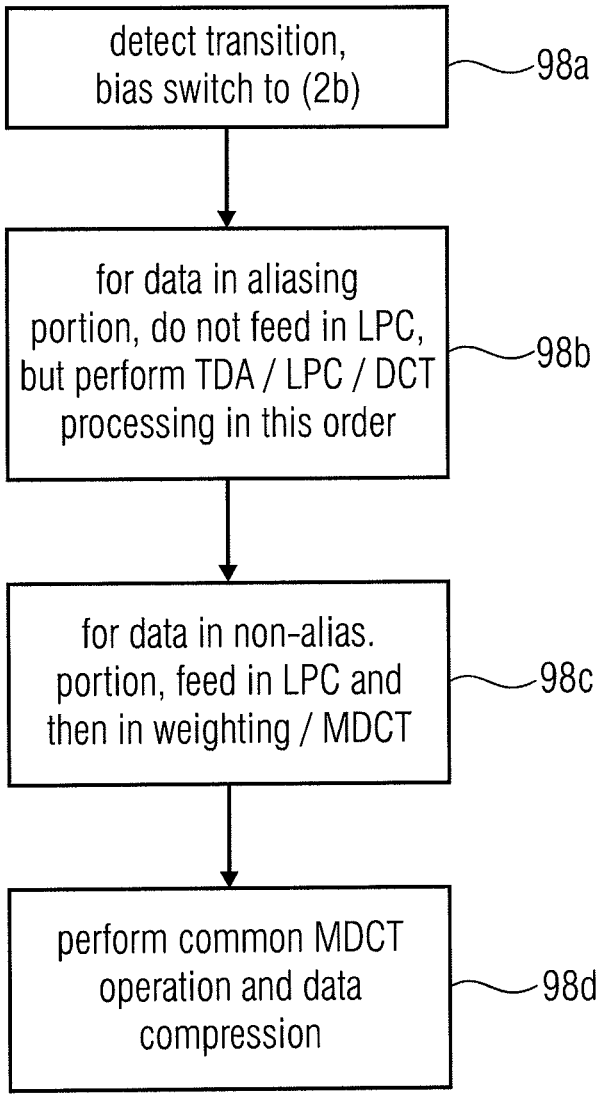
FIG. 9B is a flow chart illustrating the process performed in the controller of FIG. 9A.

Specifically, the controller 98 illustrated in FIG. 9A operates as indicated in FIG. 9B. In step 98*a*, a transition is detected, where this transition is indicated by the decision stage 300. Then, the controller 98 is active to bias the switch 521 so that the switch 521 selects alternative (2*b*) in any case.

Then, step 98*b* is performed by the controller 98. Specifically, the controller is operative to take the data in the aliasing portion and to not feed the data into the LPC 510 directly, but to feed the data before LPC filter 510 directly, without weighting by an LPC filter, into the TDA block 527*a*. Then, this data is taken by the controller 98 and weighted and, then, fed into DCT block 527*b*, i.e., after having been weighted by the weighting filter at the controller 98 output. The weighting filter at the controller 98 uses the LPC coefficients calculated in the LPC block 510 after a signal analysis. The LPC block is able to feed either ACELP or TCX and moreover perform a LPC analysis for obtaining the LPC coefficients. The DCT portion 527*b* of the MDCT device consists of the TDA device 527*a* and the DCT device 527*b*. The weighting filter at the output of the controller 98 has the same characteristic as the filter in the LPC block 510 and a potentially present additional weighting filter such as the perceptual filter in AMR-WB+ TCX processing. Hence, in step 98*b*, TDA-, LPC-, and DCT processing are performed in this order.

The data in the further portion is fed, at step 98*c*, into the LPC block 510 and, subsequently, in the MDCT block 527*a*, 527*b* as indicated by the normal signal path in FIG. 9A. In this case, the TCX weighting filter is not explicitly illustrated in FIG. 9A because it belongs to the LPC block 510.

As stated before, the data in the aliasing portion is, as indicated in FIG. 8A windowed in block 527*a*, and the windowed data generated within block 527 is LPC filtered at the controller output and the result of the LPC filtering is then applied to the transform portion 527*b* of the MDCT block 527. The TCX weighting filter for weighting the LPC residual signal generated by LPC device 510 is not illustrated in FIG. 9A. Additionally, device 527*a* includes the windowing stage 80 and, the folding stage 82 and device 527*b* includes the DCT IV stage 83 as discussed in connection with FIG. 8A. The DCT IV stage 83/527*b* then receives the aliasing portion after processing and the further portion after the corresponding processing and performs the common MDCT operation, and a subsequent data compression in block 528 is performed as indicated by step 98*d* in FIG. 9B. Therefore, in case of an encoder hardwired or software-controlled as discussed in connection with FIG. 9A, the controller 98 performs the data scheduling as indicated in FIG. 9B between the different blocks 510 and 527*a*, 527*b*.

On the decoder side, a transition controller 99 is provided in addition to the blocks indicated in FIG. 11B, which have already been discussed.

The functionality of the transition controller 99 is discussed in connection with FIG. 10B.

Figure 10A:
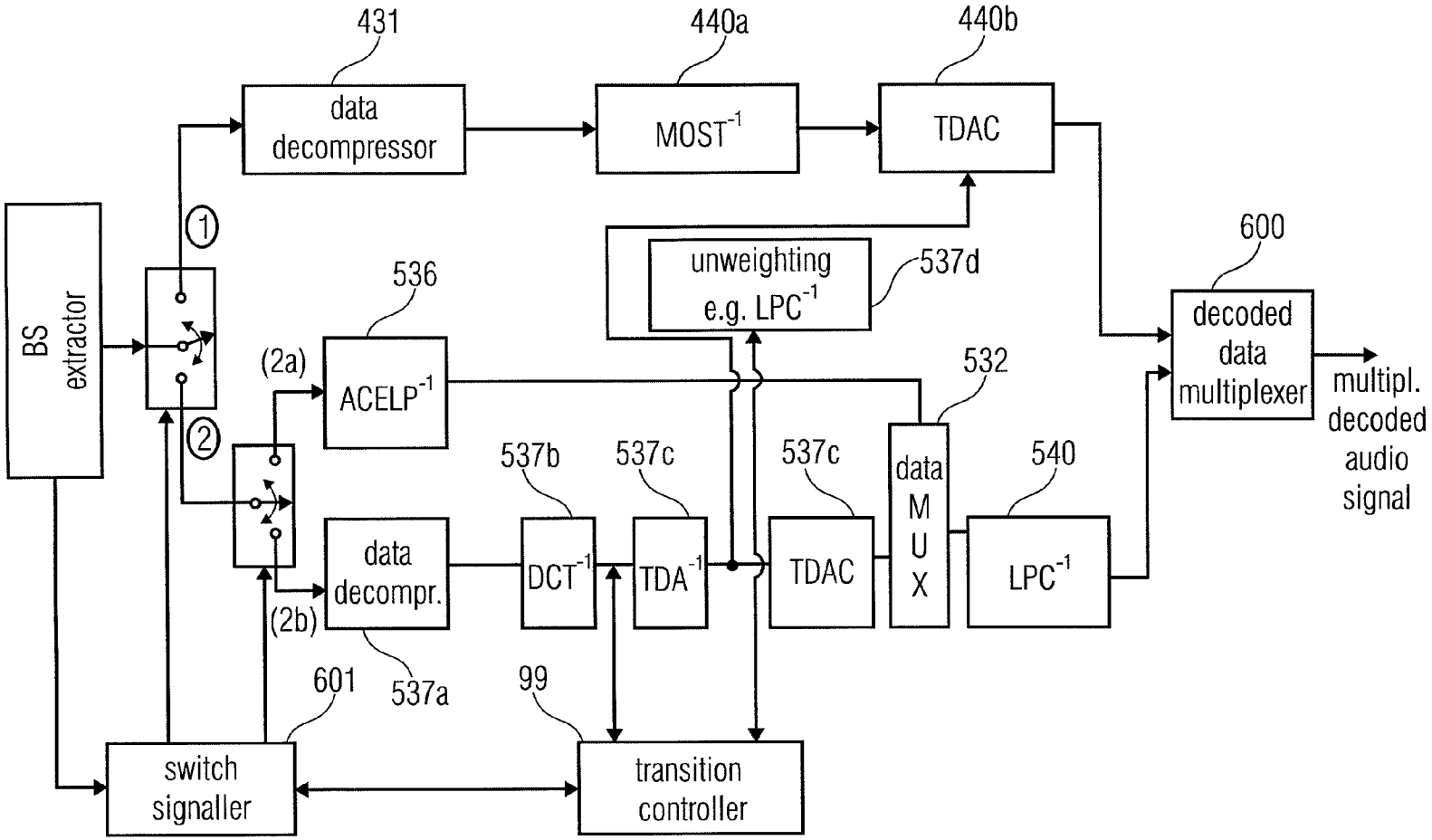
FIG. 10A is an embodiment of a decoder in a hybrid switched coding scheme.
Figure 10B:
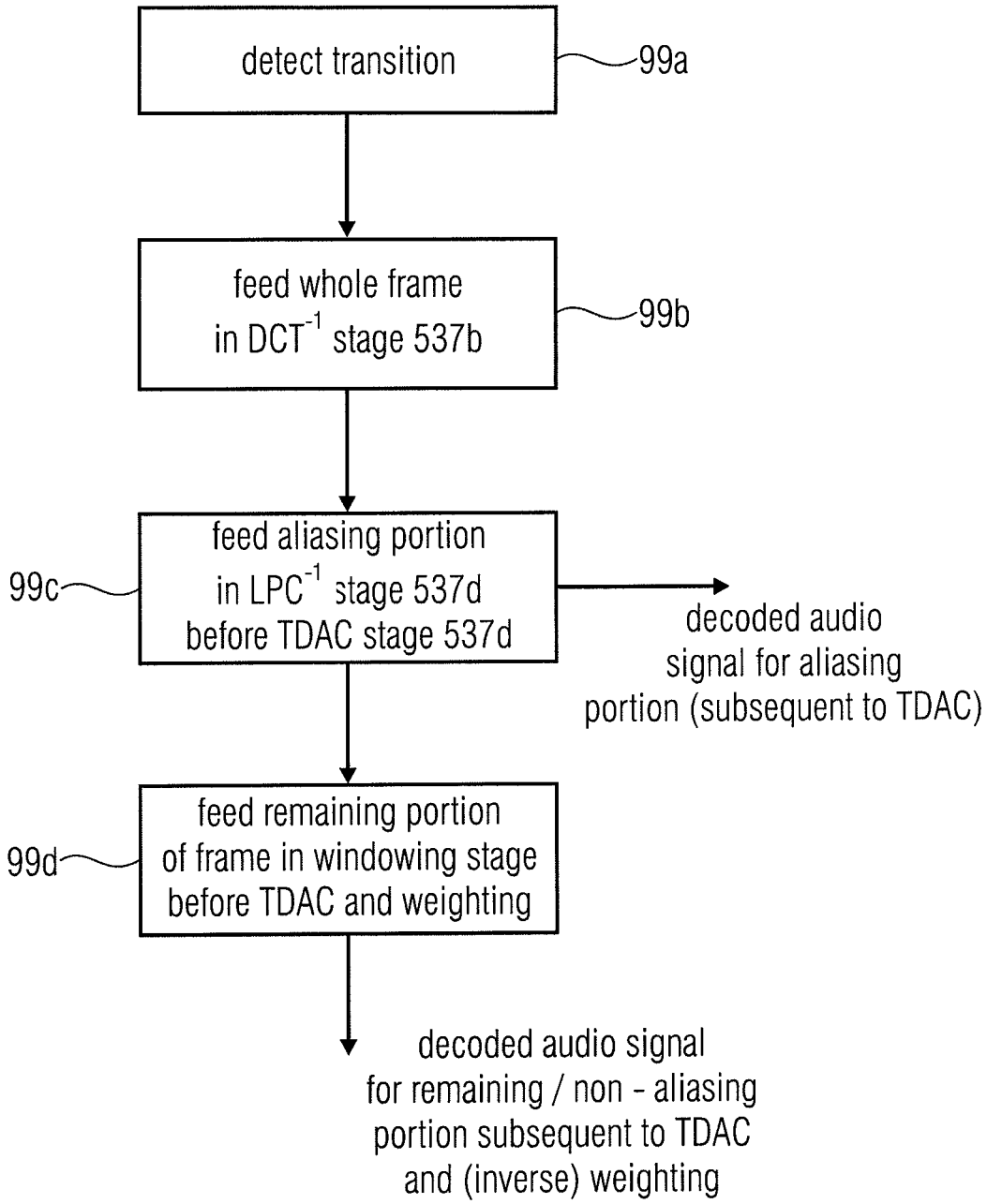
FIG. 10B is a flow chart for illustrating the procedure performed in the transition controller of FIG. 10A.

As soon as the transition controller 99 has detected a transition as outlined in step 99*a* in FIG. 10B, the whole frame is fed into the $MDCT^{-1}$ stage 537*b* subsequent to a data decompression in data decompressor 537*a*. This procedure is indicated in step 99*b* of FIG. 10B. Then, as indicated in step 99*c*, the aliasing portion is fed directly into the $LPC^{-1}$ stage before performing a TDAC processing. However, the aliasing portion is not subjected to a complete "MDCT" processing, but only, as illustrated in FIG. 8B, subjected to the inverse transform from the fourth domain to the second domain.

Feeding the aliasing portion subsequent to the $DCT^{-1}$ IV stage 86/stage 537*b* of FIG. 8B into the additional $LPC^{-1}$ stage 537*d* in FIG. 10A makes sure that a transform from the second domain to the first domain is performed, and, subsequently, the unfolding operation 87 and the windowing operation 88 of FIG. 8B are performed in block 537*c*. Therefore, the transition controller 99 receives data from block 537*b* subsequent to the $DCT^{-1}$ operation of stage 86, and then feeds this data to the $LPC^{-1}$ block 537*d*. The output of this procedure is then fed into block 537*d* to perform unfolding 87 and windowing 88. Then, the result of windowing the aliasing portion is forwarded to TDAC block 440*b* in order to perform an overlap-add operation with the corresponding aliasing portion of an AAC-MDCT block. In view of that, the order of processing for the aliasing block is: data decompression in 537*a*, $DCT^{-1}$ in 537*b*, inverse LPC and inverse TCX perceptual weighting (together meaning inverse weighting) in 537*d*, $TDA^{-1}$ processing in 537*c* and, then, overlap and add in 440*b*.

Nevertheless, the remaining portion of the frame is fed into the windowing stage before TDAC and inverse filtering/weighting in 540 as discussed in connection with FIG. 6 and as illustrated by the normal signal flow illustrated in FIG. 10A, when the arrows connected to block 99 are ignored.

In view of that, step 99*c* results the decoded audio signal for the aliasing portion subsequent to the TDAC 440*b*, and step 99*d* results in the decoded audio signal for the remaining/further portion subsequent to the TDAC 537*c* in the LPC domain and the inverse weighting in block 540.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Apparatus for encoding an audio signal, comprising:

a windower for windowing a first block of the audio signal using an analysis window, the analysis window comprising an aliasing portion, and a further portion;

a processor for processing a first sub-block of the audio signal associated with the aliasing portion by transforming the first sub-block into a different domain from a domain, in which the audio signal is, subsequent to windowing the first sub-block to acquire a processed first sub-block, and for processing a second sub-block of the audio signal associated with the further portion by transforming the second sub-block into the different domain before windowing the second sub-block to acquire a processed second sub-block; and a transformer for converting the processed first sub-block and the processed second sub-block from the different domain into a further domain using a block transform rule to acquire a converted first block, wherein the apparatus is configured for further processing the converted first block using a data compression algorithm.

2. Apparatus in accordance with claim 1, which is configured for processing a second block of the audio signal overlapping with the first block using a second analysis window comprising a further aliasing portion corresponding to the aliasing portion of the first analysis window.

3. Apparatus in accordance with claim 1, in which the domain, in which the audio signal is positioned, is a time domain, in which the different domain is an LPC domain, in which a third domain, in which a second block of the audio signal overlapping with the first block of the audio signal is encoded, is a frequency domain, and in which the further domain, in which the transformer is configured for transforming, is an LPC frequency domain, and wherein the processor comprises an LPC filter for transforming from the first domain to the second domain, or wherein the transformer comprises a Fourier-based conversion algorithm for transforming input data into the frequency domain of the input data such as a DCT, a DST, an FFT, or a DFT.

4. Apparatus in accordance with claim 1, in which the windower comprises a folding function for folding input values to acquire output values, the number of output values being smaller than the number of input values, wherein the folding function is such that time aliasing is introduced into the output values.

5. Apparatus in accordance with claim 1, in which the windower is operative to perform the windowing to acquire the input values for a subsequently performed folding function.

6. Apparatus in accordance with claim 1, in which the apparatus comprises a first encoding branch for encoding the audio signal in a frequency domain, and a second encoding branch for encoding the audio signal based on a further frequency domain, the further frequency domain being different from the frequency domain, wherein the second encoding branch comprises a first sub-branch for encoding the audio signal in the further frequency domain, and a second sub-branch for encoding the audio signal in a third domain different from the further frequency domain, the apparatus further comprising a decision stage for deciding, whether a block of audio data is represented in an output bit stream by data generated using the first encoding branch or the first sub-branch or the second sub-branch of the second encoding branch, and wherein the processor is configured for controlling the decision stage to decide in favor of the first sub-branch, when the transition from the first encoding branch to the second encoding branch or from the second encoding branch to the first encoding branch is to be performed.

7. Apparatus in accordance with claim 1, in which the further portion comprises a further non-aliasing portion and an additional aliasing portion or an even further aliasing portion overlapping with a corresponding aliasing portion of a neighboring block of the audio signal.

8. Apparatus for decoding an encoded audio signal comprising an encoded first block of audio data, the encoded block comprising an aliasing portion and a further portion, comprising:

a processor for processing the aliasing portion by transforming the aliasing portion into a target domain before performing a synthesis windowing to acquire a windowed aliasing portion, and for performing a synthesis windowing of the further portion before performing a transform into the target domain; and a time domain aliasing canceller for combining the windowed aliasing portion and a further windowed aliasing portion of an encoded second block of audio data subsequent to the transform of the aliasing portion of the encoded first block of audio data into the target domain to acquire a decoded audio signal corresponding to the aliasing portion of the first block.

9. Apparatus in accordance with claim 8, in which the processor comprises a transformer for converting the aliasing portion from a fourth domain into a second domain, and wherein the processor furthermore comprises a further transformer for converting the aliasing portion represented in the second domain into a first domain, wherein the transformer or the further transformer is operative to perform a block-based frequency time conversion algorithm.

10. Apparatus in accordance with claim 8, in which the processor is operative to perform an unfolding operation for acquiring output data comprising a number of values larger than a number of values input into the unfolding operation.

11. Apparatus in accordance with claim 8, in which the processor is operative to use a synthesis windowing function being related to an analysis window function used when generating the encoded audio signal.

12. Apparatus in accordance with claim 8, in which the encoded audio signal comprises a coding mode indicator indicating a coding mode for the encoded first block and the encoded second block, wherein the apparatus further comprises a transition controller for controlling the processor, when the coding mode indicator indicates a coding mode change from a first coding mode to a different second coding mode or vice versa, and for controlling the processor to perform a single operation for a complete encoding block, when the coding mode change between two encoding blocks is not signaled.

13. Apparatus in accordance with claim 8, in which a first coding mode and a second coding mode comprise an entropy decoding stage, a dequantizing stage, a frequency-time converting stage comprising an unfolding operation, and a synthesis windowing stage, in which the time domain aliasing canceller comprises an adder for adding corresponding aliasing portions of encoded blocks acquired by the synthesis windowing stage, the corresponding aliasing portions being acquired by an overlapping processing of the audio signal, and in which, in the first coding mode, the time domain aliasing canceller is configured for adding portions of blocks acquired by the synthesis windowing to acquire, as an output of the addition, the decoded signal in the target domain, and in which, in the second coding mode, the output of the addition is processed by the processor to perform a transform of the output of the addition to the target domain.

14. Method of encoding an audio signal, comprising:

windowing, by a windower, a first block of the audio signal using an analysis window, the analysis window comprising an aliasing portion, and a further portion;

processing, by a processor, a first sub-block of the audio signal associated with the aliasing portion by transforming the first sub-block into a different domain from a domain, in which the audio signal is, subsequent to windowing the first sub-block to acquire a processed first sub-block;

processing, by the processor, a second sub-block of the audio signal associated with the further portion by transforming the second sub-block into the different domain before windowing the second sub-block to acquire a processed second sub-block;

converting, by a converter, the processed first sub-block and the processed second sub-block from the different domain into a further domain using a block transform rule to acquire a converted first block; and further processing, by the processor, the converted first block using a data compression algorithm, wherein at least one of the processor and the converter comprises a hardware implementation.

15. Method of decoding an encoded audio signal comprising an encoded first block of audio data, the encoded block comprising an aliasing portion and a further portion, comprising:

processing, by a processor, the aliasing portion by transforming the aliasing portion into a target domain before performing a synthesis windowing to acquire a windowed aliasing portion;

a further portion synthesis windowing, by a synthesis windower, of the further portion before performing a transform into the target domain; and combining, by a combiner, the windowed aliasing portion and a further windowed aliasing portion of an encoded second block of audio data to acquire a time-domain aliasing cancellation, subsequent to the transform of the aliasing portion of the encoded first block of audio data into the target domain to acquire a decoded audio signal corresponding to the aliasing portion of the first block, wherein at least one of the processor, the synthesis windower and the combiner comprises a hardware implementation.

16. Non-transitory storage medium having stored thereon a computer program comprising a program code for performing, when running on a computer, the method for encoding an audio signal, the method comprising:

windowing a first block of the audio signal using an analysis window, the analysis window comprising an aliasing portion, and a further portion;

processing a first sub-block of the audio signal associated with the aliasing portion by transforming the first sub-block into a different domain from a domain, in which the audio signal is, subsequent to windowing the first sub-block to acquire a processed first sub-block;

processing a second sub-block of the audio signal associated with the further portion by transforming the second sub-block into the different domain before windowing the second sub-block to acquire a processed second sub-block;

converting the processed first sub-block and the processed second sub-block from the different domain into a further domain using a block transform rule to acquire a converted first block; and further processing the converted first block using a data compression algorithm.

17. Non-transitory storage medium having stored thereon a computer program comprising a program code for performing, when running on a computer, the method of decoding an encoded audio signal comprising an encoded first block of audio data, the encoded block comprising an aliasing portion and a further portion, the method comprising:

processing the aliasing portion by transforming the aliasing portion into a target domain before performing a synthesis windowing to acquire a windowed aliasing portion;

a further portion synthesis windowing of the further portion before performing a transform into the target domain; and combining the windowed aliasing portion and a further windowed aliasing portion of an encoded second block of audio data to acquire a time-domain aliasing cancellation, subsequent to the transform of the aliasing portion of the encoded first block of audio data into the target domain to acquire a decoded audio signal corresponding to the aliasing portion of the first block.

* * * * *

UNITED STATES PATENT AND TRADEMARK OFFICE

CERTIFICATE OF CORRECTION

PATENT NO. : 8,862,480 B2
APPLICATION NO. : 13/004351
DATED : October 14, 2014
INVENTOR(S) : Guillaume Fuchs et al.

It is certified that error appears in the above-identified patent and that said Letters Patent is hereby corrected as shown below:

On the Title page

Item (73) Assignee: "Fraunhofer-Gesellschaft zur Foerderung der Angewandten Forschung E.V."
should read --Fraunhofer-Gesellschaft zur Foerderung der angewandten Forschung e.V.--

Signed and Sealed this
Eighth Day of March, 2016

Michelle K. Lee

Michelle K. Lee
*Director of the United States Patent and Trademark Office*